United States Patent [19]

Itaya et al.

[11] Patent Number: 5,054,419

[45] Date of Patent: Oct. 8, 1991

[54] IMAGE FORMING APPARATUS

[75] Inventors: Masahiko Itaya; Yukio Okamoto; Kazuo Yasuda; Masayuki Kamegamori; Kunihisa Yoshino; Shizuo Morita; Masakazu Fukuchi; Akihiko Tamura; Hiroshi Fuma; Toshiro Fujimori; Tsugio Sugizaki, all of Hachioji, Japan

[73] Assignee: Konica Corporation, Tokyo, Japan

[21] Appl. No.: 604,321

[22] Filed: Oct. 25, 1990

Related U.S. Application Data

[63] Continuation of Ser. No. 346,872, May 3, 1989, abandoned.

[30] Foreign Application Priority Data

| | | | |
|---|---|---|---|
| May 9, 1988 | [JP] | Japan | 63-112975 |
| May 18, 1988 | [JP] | Japan | 63-122264 |
| Jul. 4, 1988 | [JP] | Japan | 63-167076 |
| Aug. 31, 1988 | [JP] | Japan | 63-217417 |

[51] Int. Cl.[5] ..... G03G 15/09

[52] U.S. Cl. ..... 118/657; 118/261; 355/253

[58] Field of Search ..... 118/657, 261, 413, 414, 118/262, 658; 355/253

[56] References Cited

U.S. PATENT DOCUMENTS

| | | | |
|---|---|---|---|
| 4,100,884 | 7/1978 | Mochizuki et al. . | |
| 4,406,536 | 9/1983 | Suzuki | 355/3 DD |
| 4,458,627 | 7/1984 | Hosono et al. | 118/657 |
| 4,780,741 | 10/1988 | Wada . | |
| 4,814,818 | 3/1989 | Fuma et al. . | |
| 4,908,291 | 3/1990 | Hiroshi et al. . | |

FOREIGN PATENT DOCUMENTS

| | | | |
|---|---|---|---|
| 54-51848 | 4/1979 | Japan . | |
| 55-50274 | 4/1980 | Japan | 118/658 |
| 56-109374 | 8/1981 | Japan | 118/658 |
| 58-65465 | 4/1983 | Japan . | |
| 59-19969 | 2/1984 | Japan . | |
| 59-126567 | 7/1984 | Japan . | |
| 60-46577 | 3/1985 | Japan . | |
| 62-17774 | 1/1987 | Japan . | |
| 62-75563 | 4/1987 | Japan . | |
| 62-231276 | 10/1987 | Japan | 355/253 |

OTHER PUBLICATIONS

*IBM Tech Disc Bull;* vol. 14, No. 9, Feb. 1972, pp. 2787,2788, Class 118 Sub 658.

Patent Abstracts of Japan vol. 7, No. 224 (P. 227)(1369) 10/5/83, JPA-58-115462.

Patent Abstracts of Japan vol. 8, No. 259 (P. 317) (1696) 11/28/84, JPA-59-129879.

Patent Abstracts of Japan vol. 9, No. 116 (P. 357) (1839) 5/21/85, JPA-60-2967.

*Primary Examiner*—R. L. Moses

*Attorney, Agent, or Firm*—Jordan B. Bierman

[57] ABSTRACT

A developing apparatus for supplying a developer to a photoreceptor so that an electrostatic latent image on the photoreceptor is developed with the developer. The developing apparatus comprises a developer conveyer, having a rigid surface, for conveying the developer to a developing zone; a developer layer-thickness regulator, shaped like a bar and having a rigid surface portion of the curvature radius between 0.5 mm and 15 mm, for regulating the thickness of the developer to be conveyed to the developing zone; and a supporter for supporting the developer layer-thickness regulator.

31 Claims, 19 Drawing Sheets

IMAGE FORMING APPARATUS

This application is a continuation of application Ser. No. 07/346,872, filed May 3, 1989, now abandoned.

BACKGROUND OF THE INVENTION

This invention relates to a developing apparatus applied to the development of the latent image on an image forming body more particularly in an electrophotographic image forming apparatus.

In the case of a electrophotographic image forming apparatus in which one component type developer or two component type developer is used, the thickness of the developer layer on a rotatable developing sleeve must be thin and uniform in order to obtain a good image.

Conventionally, the thickness of a developer layer has been regulated by a fixed regulating plate, but there is a limit in accuracy when the fixed regulating plate is applied to the developing sleeve. As a result, the lower limit of the developer layer thickness is approximately 0.3 mm. Moreover, it has been difficult to obtain a uniform thin developer layer on the developing sleeve. Therefore various kinds of developer layer thickness regulating apparatuses have been invented to obtain an even thick developer layer apart from using a fixed regulating plate. Some examples are explained below.

(a) The developer layer forming apparatus which is described in Japanese Patent Publication Open to Public Inspection No. 43038/1979 discloses a developer layer forming apparatus for one component developer that has a developer layer thickness regulating device consisting of a resilient blade. in which one end is free and the other end of which comes into contact with the developing sleeve with pressure.

(b) The developer layer forming apparatus which is described in Japanese Patent Publication Open to Public Inspection No. 51848/1979 discloses a developer layer forming apparatus that has a resilient blade comprising a resilient metal plate and a soft elastic material in a pile, and the middle part of the soft elastic material comes into contact with the developing sleeve with pressure to regulate the thickness of one component type developer.

(c) The developer layer forming apparatus which is described in Japanese Patent Publication Open to Public Inspection No. 126567/1984 and No. 129879/1984 discloses a developing layer forming apparatus in which an elastic roller rotating intermittently or continuously is pressed on the developint sleeve and the developer thickness is regulated by means of nip created at the point of contact of two rollers. (d) The developer layer forming apparatus which is described in Japanese Patent Publication No. 12627/1985 discloses an apparatus applied to a developing apparatus which uses one component type developer. In the apparatus, a roller comes into contact with a developing sleeve made of an elastic material and the thickness of the developer is regulated.

(e) As an improved apparatus which is applied to a two component type developer, an art is disclosed in Japanese Patent Publication Open to Public Inspection No. 191868/1987, and No. 191869/1987. The disclosed art is a means to form a thin developer layer on a developing sleeve which is appropriate for non-contact development.

A resilient blade supported by a supporting unit comes into contact with the developing sleeve with pressure. The edge of the resilient blade is set to oppose the stream of the developer on the developing sleeve. The thickness of the developer layer comprising magnetic carrier and toner on the surface of the developing sleeve is regulated in this way. By this method, the thickness of the developer is easily kept thinner and more accurate than by the conventional method.

(f) Other prior arts for use with two component type developer are disclosed in Japanese Patent Publication Open to Public No. 189582/1986 and No. 75563/1987. The arts disclosed will be described as follows. A rigid, layer thickness regulating plate is installed in a developing apparatus and a magnetic substance is mounted on the back of the regulating plate. The middle part or the edge of the regulating plate is pressed onto the developing sleeve by the force of the magnetic attraction between the above-mentioned magnet mounted on the back of the regulating blade and a fixed magnet installed in the developing sleeve.

The conventional developer layer forming apparatuses have faults which will be explained as follows.

In cases (a) and (b) mentioned above, the apparatus utilizes the force which is created by bending the developer layer thickness regulating resilient blade, so the force tends to fluctuate and the blade tends to vibrate according to variations in the rotating speed of the developing sleeve, the nip position and the developer layer thickness. Furthermore, because countermeasures are not taken to prevent the vibration of the developer layer thickness regulating resilient blade, it vibrates in resonance to a vibration which occurs in the apparatus. That is the reason why obtaining a developer layer with a uniform thickness by this apparatus is difficult. Particularly in the case of (b) mentioned above, the developer sleeve is pressed by a soft resilient member, so this tendency is greater especially in case (b), and to make the matter worse, the geometrical shape of the nip is subject to influence by variation of the developing sleeve rotating speed, the nip position, and the developer layer thickness. Therefore, the area of the nip varies. Accordingly, the developer thickness tends to be uneven. Other than these problems, in the case of forming a nip, if one of the nip forming materials or both of them consist of a soft resilient material, further problems will be caused, such as the clogging at the nip caused by the developer and the deformation of the soft resilient material caused by abrasion. These inconveniences tend to occur when developers which contain hard materials such as magnetic materials and fluidization agents are used. The apparatus explained in case (c) is better than the apparatus explained in case (a) in terms of obtaining a stable, uniform, and thin developer layer, but the apparatus (c) is inferior to (a) in its efficiency in dissolving of aggregated particles according to the use of the rotating developer layer thickness regulation means, and in eliminating aggregated particles. It causes a problem in which a mass of particles aggregated at the nip is held as it is, and then is pushed through along with the rotation of the rotating body. Because of the problem, satisfactory efficiency can not always be obtained even if an intermittent operation is conducted, and the image quality gets worse, causing dirty marks and stains. A further shortcoming of the apparatus is that the rotating mechanism, the pressure contact mechanism and so on become complicated in order to balance the pressure.

The pressure area of the developer layer thickness regulating plate of the apparatuses (a), (b), (c), and (d) mentioned above is comparatively large in order to keep the developer layer thickness constant. The reason why is that a large pressure area is necessary in a conventional developing apparatus in which the quantity of developer fed to the nip varies from moment to moment.

Case (c) and Case (d) disclose technology relating to a resilient developing sleeve which is appropriate for a non-magnetic one component type developer, wherein the developer layer thickness regulating plate is pressed against it to form a thin developer layer. Since this technology has a shortcoming in that the developing sleeve is deformed permanently or the elastic modulus of the developer layer thickness regulating plate is apt to vary when it is used for a long time, a stable developer layer can not be formed.

The apparatus of Case (e) was developed for use with the two component type developer, but it is not able to maintain constant efficiency over a long term.

In Case (a), (b), (e), and (f), a thin developer layer is formed by pressing a resilient developer layer thickness regulating blade against a metal developing sleeve. So, it has several defects in that the elastic modulus of the resilient blade varies when used for a long time, the resilient blade causes parmanent deforms, and the developer layer thickness regulating blade needs to be often replaced. It has little endurance. Moreover, if the resilient blade is installed in the apparatus only slightly incorrectly, the pressure on the developing sleeve will vary. As a result, it is difficult to stably regulate the developer layer thickness. The reason this type of apparatus has a serious defect is that extreme accuracy is required in mass production.

In Case (f), the apparatus has a function to dissolve the aggregate of developer which is caused by the magnetic attraction between the magnet installed on the back of the developer layer thickness regulating plate and the magnet installed inside the developing sleeve. But the magnets attract through the plate, so the longer the distance between the two magnets is, the more the magnetic attraction decreases. In other words, the distance variation has much influence on the pressure, therefore the effect of pressing the blade against the developer layer is not stable and uniform, and the aggregate of toner or developer passes through, or the predetermined layer thickness can not be obtained because the apparatus gets clogged by the toner or developer. When clogging occurs, white streaks appear on the image. These are the defects of the apparatus of Case (f).

An object of the invention is to solve these problems and to provide a developing apparatus which can stably form a uniform thick developer layer on a developing sleeve and can prevent aggregated developer or toner from moving into the developing zone.

SUMMARY OF THE INVENTION

The objects can be attained by the developing apparatus, as first embodiment, the characteristics of which will be explained as follows.

The developing apparatus has a rigid developing sleeve and a developer amount regulator which is pressed against the developing sleeve and controls the developer layer thickness on the developing sleeve. The part of the regulator which comes into contact with the developing sleeve with pressure, is made from rigid materials. The radius of curvature of the developer amount regulator is from 0.5 mm to 15 mm.

The objects of the present invention can be also effectively attained by second embodiment described as follows. The main structure of the apparatus of the invention consists of a developing sleeve which carries the developer on its surface and a cylindrical developer amount regulator which regulates the amount of the developer carried on the developing sleeve. The inside of the developing sleeve is provided with stationary magnets. The developer regulator faces towards the magnets and is pressed against the developing sleeve. The portion of the developer regulator which comes into contact with the developing sleeve with pressure is made from rigid magnetic materials and its radius of curvature is from 0.5 mm to 15 mm.

In these first and second embodiments, it is preferable to fix the magnetic roller stable, and allocate the developer regulator faced to one of the magnets of the magnetic roller. In this structure of the invention, an effective method for the control of the developer thickness on the developing sleeve surface is to hold the developer regulator by a holder and to install a regulator position adjusting device between the holder and the developer layer regulator. In addition, the developer regulator is desirably a bar-shaped member more desirably, the developer regulator is a cylindrical member.

In the first embodiment of the present invention, stable and uniform thin developer can be formed by pressing the rigid bar-shaped devoloper regulator against the developing sleeve which is rigid like the developer regulator.

In this embodiment, the phrase 'rigidity' is defined as having rigidity more than $10^4$ kg/cm$^2$.

For example, suitable material is iron is copper of the rigidity from $0.8\times10^6$ to $1.6\times10^6$ kg/cm$^2$, copper alloys of the rigidity of about $3\times10^5$ kg/cm$^2$, and nonmetals such as phenolic resin, hard vinyl chloride, polycarbonate, and polyacetal having the rigidity of from $1.0\times10^4$ to $10\times10^4$ kg/cm can be suitable. Furthermore, hard type fluororesin, hard type cellulose nitrate and so forth can also be used in the embodiment.

The inventors made an experiment explained as follows.

Using the experimental device shown in FIG. 1, developer layers were formed by sylindrical bar 50. The pressing force of the bar 50 and the diameter of the bar were adopted as the parameters and the collected data was analyzed. As a result, the graph shown in FIG. 18A was obtained. In this figure and other figures which describe the relationships with the developer conveyance amount, the developer conveyance amount means the weight of the developer per an unit area of the photoreceptor's surface after the developer is conveyed in a regulated thickness to the developing zone by means of the developer layer-thickness regulator.

The result was given when polycarbonate is used for the materials of bar 50 however, the same result can be expected when other materials such as Bakelite phenol resin, synthetic resins such as nylon, and metals such as stainless steel and aluminum are used, instead. It can be clearly seen that the quantity of the developer is determined by the balance between two forces, one is the force by which the developer is squeezed into the wedgewise portion formed by the bar 50 and the sleeve 3, and the other is the force in the direction of the sleeve created by the bar 50 which is pushed by the spring force.

In the experiments, the rigid bar, made of such as polycarbonate and having the radius of from 0.5 mm to 15 mm, was used and the bar was set so that the pressure was from 0.5 gf/mm to 10 gf/mm. Under the circumstances mentioned above, the experiments were conducted and the desired quantity of carried developer was stably obtained.

Accordingly, it was confirmed that the quantity of conveyed developer was quite stable and a uniform thin developer layer was formed compared with a developing apparatus with the conventional developer amount regulator.

The second embodiment of the invention will be explained as follows. A stable uniform thin layer of the developer was formed by pressing a rigid developer regulator made of a cylindrical magnetic material onto a developing sleeve having In this embodiment, the magnetic material having a rigidness is defined as having a rigidity of more than $10^4$ kg/cm$^2$. These materials are iron, its alloys and alloys, various kinds of magnetic metals of rigidity from $0.8\times10^6$ kg/cm$^2$, and hard resin of the rigidity from $1.0\times10^4$ to $10\times10^4$ kg/cm$^2$ which contains magnetic powder. All of these materials are used as material of the developer regulator. Chromium plated iron and iron alloy plate are also used.

To have magnetism is defined as being able to be attracted by a magnet.

The inventors, as same in the case of the first embodiment, made an experiment explained as follows. Using the experimental device shown in FIG. I, developer layers were formed by magnetic and nonmagnetic bars 50. The magnet roller 4 with the plural magnets was fixed inside the sleeve, and the developing sleeve 3 was rotated around the magnets in the direction of the arrow shown in the drawing. The bar 50 was pressed to the developing sleeve 3 with a spring scale. The position where the bar 50 pressed the sleeve faced a magnetic pole of the magnet roller 4. The pressing force of the bar 50 and the diameter of the bar were adopted as the parameters and the collected data was analyzed. As a result, the graph shown in FIG. 2 was obtained. In the case of a nonmagnetic bar, pressure means the addition of the load F of the spring scale and the weight of the bar. In the case of a magnetic bar, the magnetic attraction force is further added. In FIG. 2, the curves drawn by continuous lines show the results of a magnetic bar and the curves drawn by chain lines show the results of the nonmagnetic bar. It can be clearly seen from the figure that the quantity of the developer is determined by the balance between two forces, one is the force by which the developer is squeezed into the wedgewise portion formed by the bar 50 and the sleeve 3, and the other is the force in the direction of the sleeve created by the bar 50 which is pushed by the spring or by both the spring and magnetic force. When a magnetic bar is adopted in this case, the quantity of the carried developer is stable against the fluctuation of the pressing force compared with a nonmagnetic bar. The FIG. 2 also shows the result when nonmagnetic stainless steel, SUS 310, specified by Japanese Industrial Standards, aluminum and polycarbonate were used for the materials of bar 50 in the case that nonmagnetic materials were required. When magnetic materials were required, stainless steels, SUS416, stainless steel SUS 416, steel alloys and hard resins which contain magnetic powder were used. The data shows the results of the experiments in which these materials were used as the bar 50.

In the device used in the experiments the rigid and magnetic bar having, the radius of from 0.5 mm to 15 mm and preferably from 1 mm to 10 mm, was used and the bar was set so that the pressure was from 1 gf/mm to 15 gf/mm. Under the circumstances mentioned above, the experiments were conducted and the desired quantity of carried developer was stably obtained. In the first and the second embodiments, if the pressure is too little the developer amount regulating efficiency is decreased, so the developer amount regulation becomes unstable, and furthermore it is subjected to external influences such as the developing apparatus vibration and so forth. Therefore, too little pressure is not unpreferable. To make the matter worse, if the pressure against the sleeve is too little, an aggregated developer passes through between the bar and the sleeve, and a uniform developer layer can not be formed.

If the pressure is too great, the developer must bear a heavy load and large amounts of developer stick to the surface of contact of the bar 50 and the sleeve 3. Accordingly, the device will not only have a short life span. but also white streaks are liable to occur because small lumps of paper dust, rubber and developer block at the developer amount regulating portion.

From the points mentioned above, the most suitable pressure is from 1 gf/mm to 15 gf/mm, preferably from 2 gf/mm to 10 gf/mm. In the case of using the two component type developer of the magnetic spherical carrier shown in FIG. 1, the above-mentioned pressure range was the most suitable, and the results of the experiments were good enough to obtain fine images of even and stable density.

A means to press the bar 50 to the sleeve 3 can be the materials described below besides above mentioned spring. It is possible for the means to use a material of non linear resiliency which has a resiliency characteristic that varies only a little compared with deflection within the range of practical use. One of the characteristic curves of this type of nonlinear resilient member is shown in FIG. 15.

Shown in FIG. 15 are characteristic curves for four types of PORON, which is a product of INOAC Corporation, and their characteristics are only a little different from one another. The horizontal axis represents deflection and the vertical axis represents load. The characteristic curves show that the curves have gentle and stable slopes within the range of practical use.

By using a nonlinear resilient member as the pressing member of the bar, fluctuations caused by inaccuracies of the casing parts or the holder parts and fluctuations in the developing apparatus assembly are absorbed. Since all of the fluctuations are absorbed in this way, fluctuation of the pressing force against the bar never occurs and the developer thickness is kept uniform.

Accordingly, it was confirmed that the quantity of conveyed developer was quite stable and a uniform thin developer layer was formed compared with a developing apparatus with the conventional developer amount regulator.

Moreover, it is possible for the means pressing the cylindrical bar onto the developing sleeve to use merely magnetic force in stead of using springs or non-linear elastic materials. The inventors changed the materials of the bar 50 shown in FIG. 6D in order to investigate the relations between the quantity of developer conveyed in the thin layer form onto the developing sleeve 3 and the magnetic characteristics of the bar 50, wherein magnetic characteristics means magnetic permeability, coercive force and saturation magnetic flux density.

FIG. 3A, FIG. 3B, and FIG. 3C are the graphs which represent these relations. These graphs show the relation between the developing sleeve 3 which is equipped with a fixed ferromagnetic body and the bar 50 which faces the magnetic body. FIG. 3A represents the relation between magnetic permeability of the bar 50 and the quantity of the thin developer layer to be conveyed. FIG. 3B represents the relation between coercive force of the bar 50 and the quantity of the thin developer layer to be conveyed. FIG. 3C represents saturation magnetic flux density of the bar 50 and the quantity of the thin developer layer to be conveyed. Therefore, the desired developer quantity to be conveyed can be determined by selecting the materials of bar 50 according to the combination of these magnetic characteristics.

In above mentioned first and second embodiments, the bar 50 which is a bar-shaped developer amount regulator can be covered by a film of polyurethane rubber or silicon rubber according to necessity.

In the case that the developer amount regulator is made of a cylindrical bar, it should be the intrinsic cylinder in order to form a thin developer layer on the surface of the developing sleeve, and the shape of portion where the developer amount regulator comes into contact with the developing sleeve through a thin developer layer should be straight. Together with this, the developing sleeve shaft and the cylindrical bar should be kept parallel.

It is very difficult to satisfy these requirements by only increasing accuracy of parts and assembly of the apparatus. In the present invention, to take measures to meet the situation, the following device also is planned. It is a position adjusting device in which an adjusting screw is installed between the bar-shaped developer amount regulator and the holder which supports it, and the device is adjusted to maintain the parallel position mentioned above. After testing of this device, it became clear that in order to form a thin developer layer uniformly on the surface of the developing sleeve, cylindricity, including straightness and deflection in this case, of the cylindrical bar-shaped developer amount regulating member and straightness or flatness of the contact portion where the cylindrical bar comes into contact with the holding portion which supports the cylindrical bar, were factors to influence the uniformity of the thin developer layer.

FIG. 4A shows the relation between the cylindricity of the cylindrical bar and the developer layer unevenness on the developing sleeve. In this example, the cylindrical bar was held by the holder in the best condition but according to the results of the experiment, It is preferable that the cylindricity of the cylindrical bar is less than 0.1 mm. More preferably, the cylindricity is approximately 0.05 mm. If the above-mentioned cylindrical bar is made of a metal, its surface can be polished by a centerless grinder.

FIG. 4B represents the relation between the straightness or flatness of the portion of the holder which regulates the position of the cylindrical bar, and the developer layer unevenness on the surface of the developing sleeve. These results were obtained by an experiment which was conducted under conditions in which the cylindricity of the cylindrical bar was good. The results show that if the straightness or flatness of the holder portion increases more than 0.2 mm, the toner layer unevenness sharply becomes worse. In order to satisfy the requirements, extruded or drown materials of such as stainless steel, aluminum, and so forth can be used. In addition, the developer layer unevenness in these figures is a relative amount.

DETAILED DESCRIPTION OF THE INVENTION

On the basis of the results mentioned above, one of the examples of the invention will be explained with reference now to the drawings from FIG. 5A to FIG. 18A.

Figure 1:
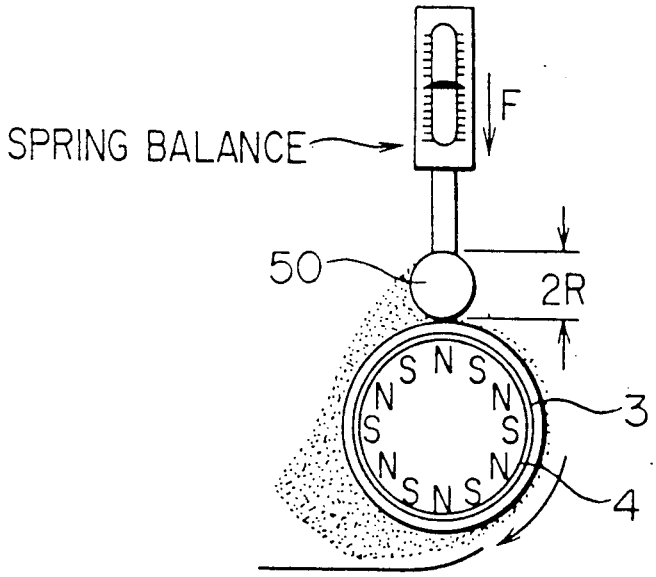
FIG. 1 is a schematic illustration of the fundamental experiment of the invention.
Figure 2:
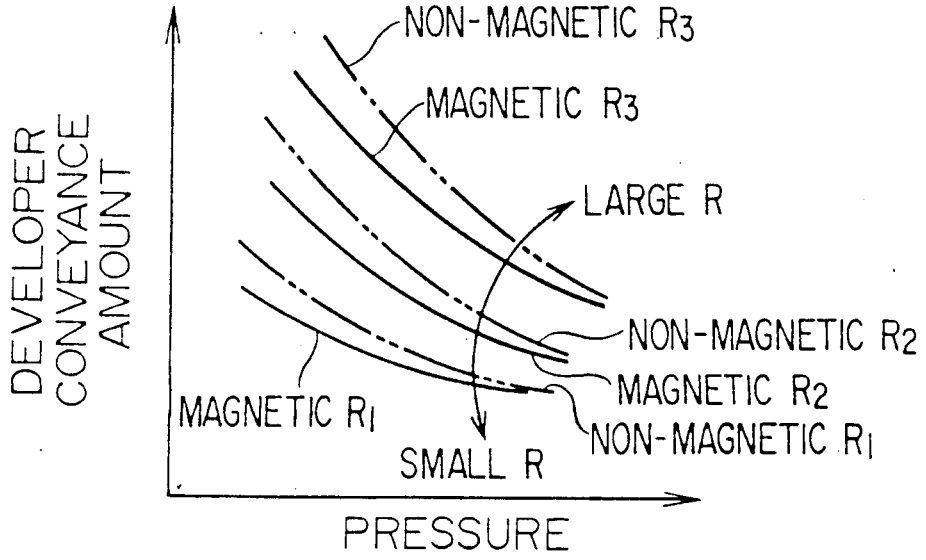
FIG. 2 is a graph which represents the relation between conveyance amount and pressure for both magnetic toner and nonmagnetic toner at various radii of curvature. This graph was obtained by the experiment shown in FIG. 1.
Figure 3A:
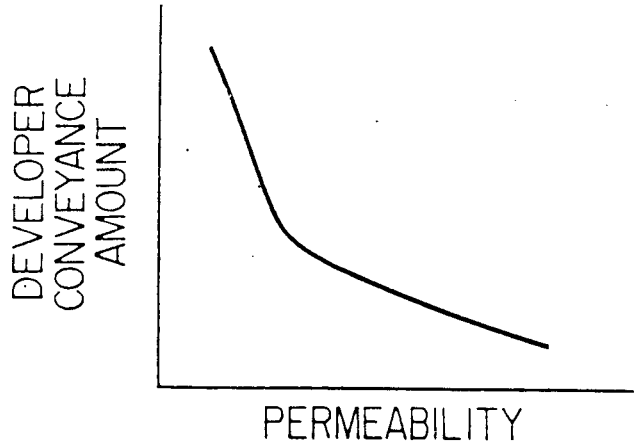
FIG. 3A, 3B, and 3C are graphs which show the relation between the magnetic characteristics of the cylindrical bar and toner conveyance amount.
Figure 3B:
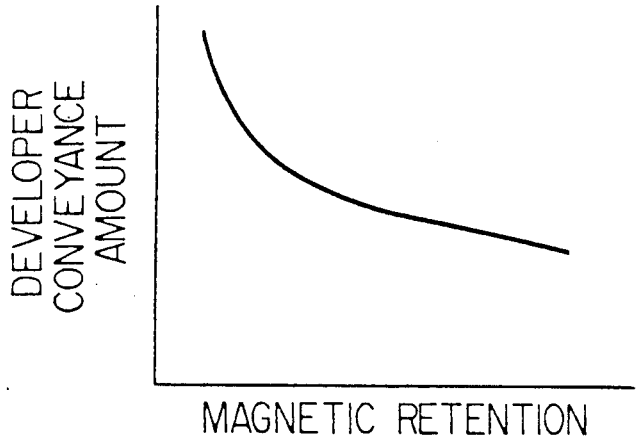
Figure 3C:
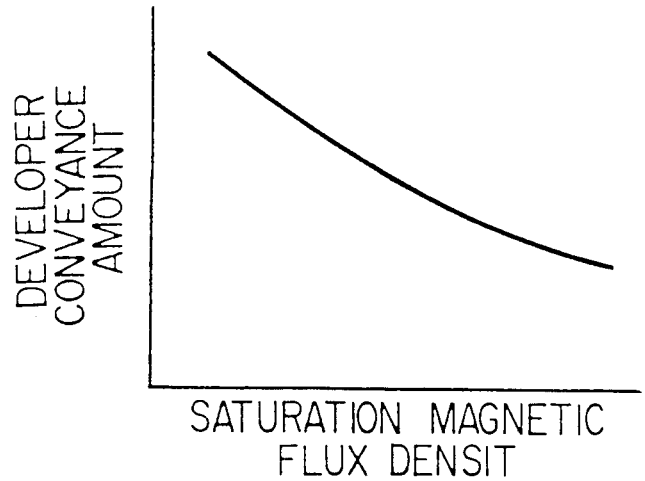
Figure 4A:
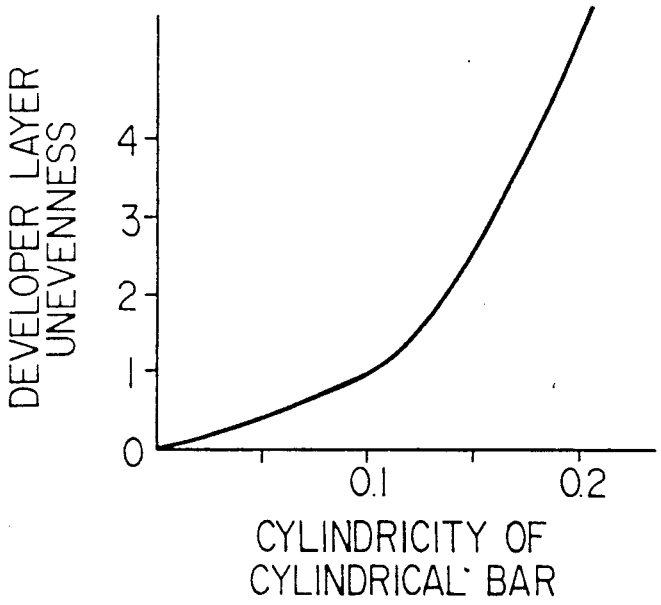
FIG. 4A is a graph which shows the relation between the cylindricity of the cylindrical bar and toner layer unevenness.
Figure 4B:
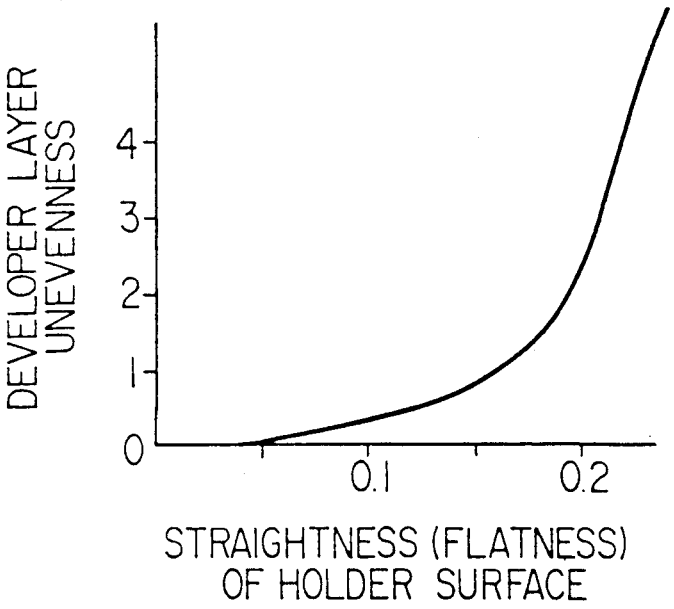
FIG. 4B is a graph which represents the relation between the straightness or flatness of the holder surface and toner layer unevenness.
Figure 5A:
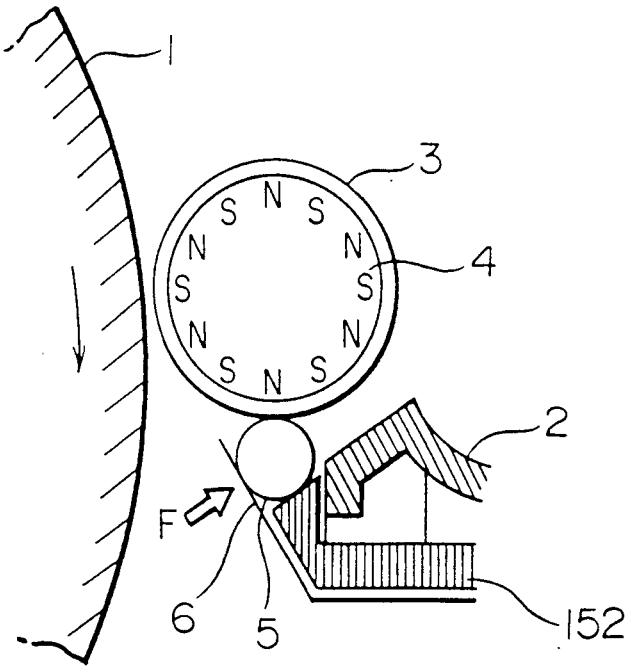
FIG. 5 is a schematic illustration which shows each embodiment.
Figure 5B:
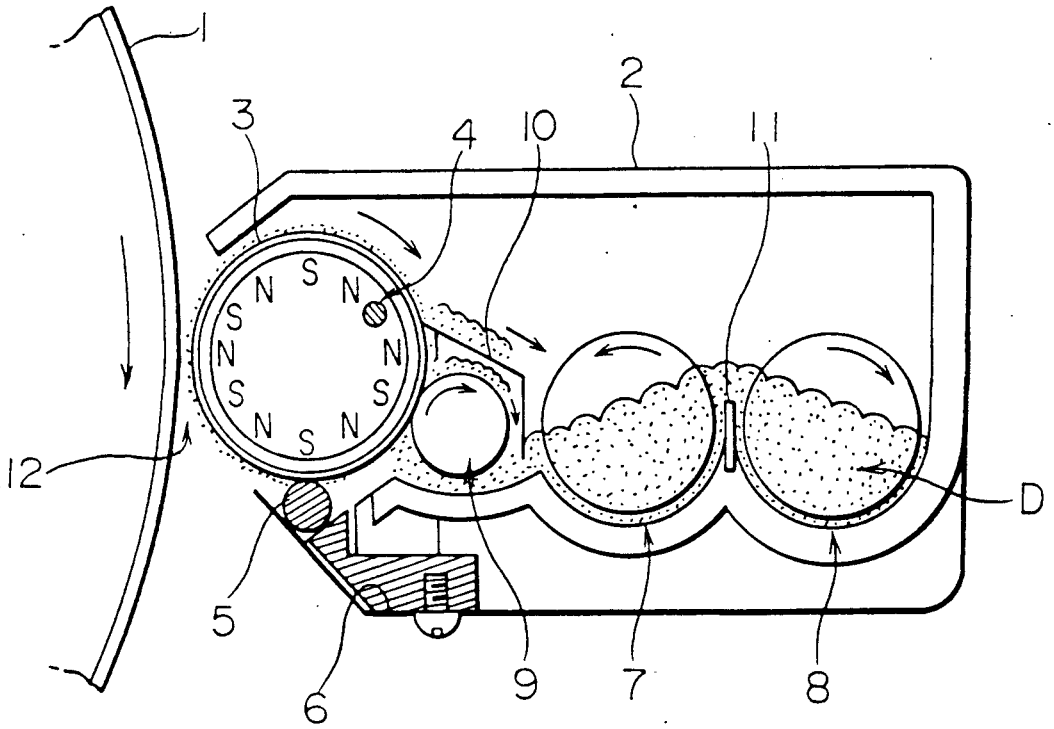

FIG. 5A shows the main portion of FIG. 5B. The device consists of the roller holder 152 which holds the cylindrical bar 5, and the flat spring 6 which presses the cylindrical bar 5. The cylindrical bar 5 is pressed against the developing sleeve 3 with pressure.

Figure 18A:
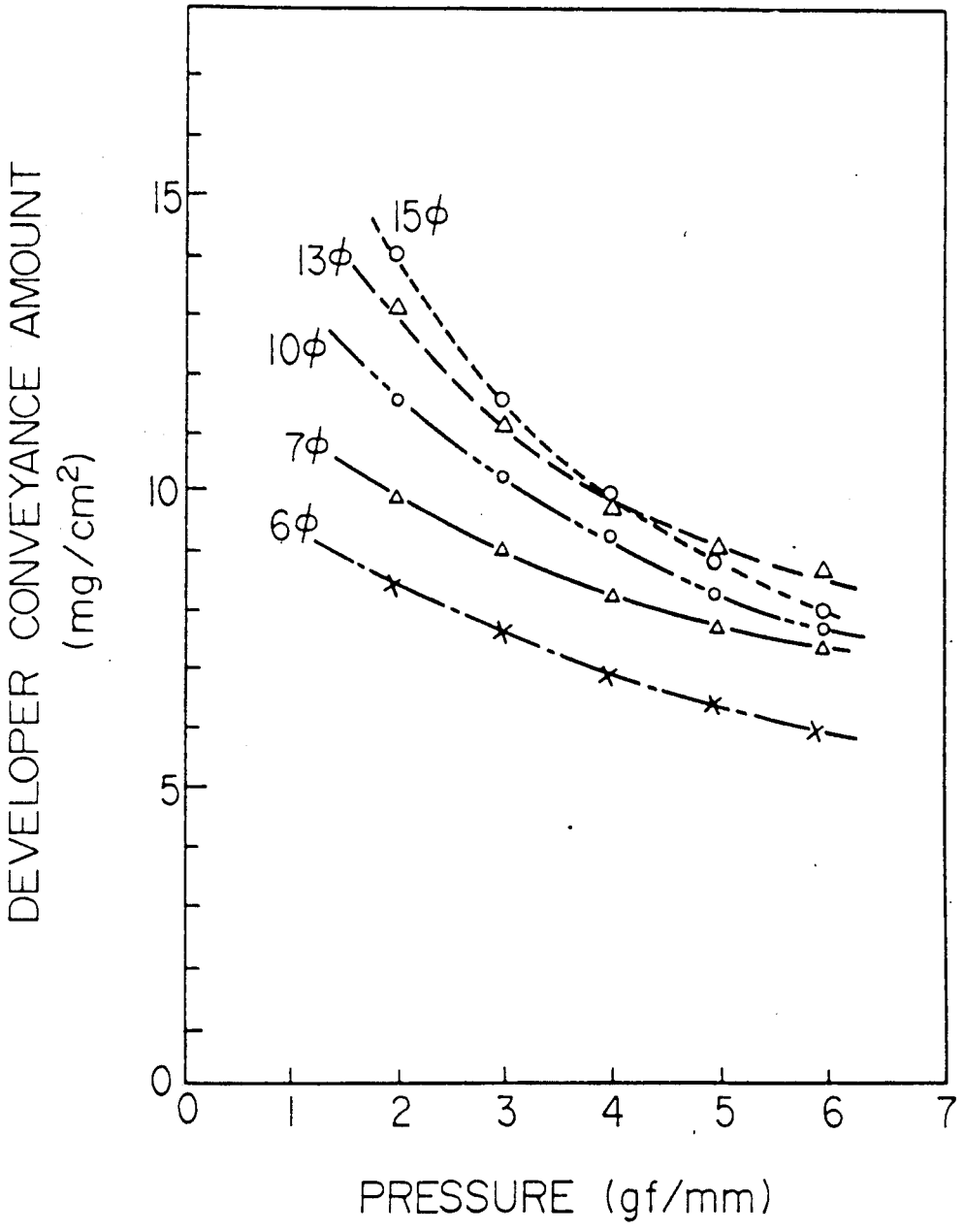
FIG. 18 and FIG. 19 are graphs which relate to the examples shown in FIG. 5.

In this device, a rigid bar with a diameter of 6 ϕmm made from polycarbonate was used as the cylindrical bar 5 and a load of from 2 gf/mm to 4 gf/mm was put on the cylindrical bar. A conveyed amount of developer of from 7 mg/cm$^2$ to 9 mg/cm$^2$ was obtained uniformly. As a result, uniform images with even density were obtained As far as the conveyance amount is concerned, an adequate conveyance amount was able to be determined by setting the diameter and the pressure as shown in FIG. 18A.

Nonmagnetic stainless steel was used as the material of the sleeve 3 in this case. But almost equal results were obtained by using rigid materials such as aluminum, hard resin, glass, ceramics, and so forth. The surface roughness of the sleeve 3 was '2 S'. The same results were obtained when the surface roughness was from '0.1 S' to '20 S'.

The following are developers used in the examples shown in FIG. 5A and FIG. 5B.

TABLE 1

| Developer | Conditions: Average particle size μm | Specific resistance Ωcm | Electrification μc/g | Toner concentration wt % |
|---|---|---|---|---|
| Carrier | 45 | more than $10^{14}$ | Ferrite particle magnetized 20 rmu/g coated with MMA/ST copolymer | |
| Toner: Black | 15 | more than $10^{14}$ | −15 | 7 |

FIG. 5B shows a sectional view of the main portion of the above-mentioned developing apparatus. The numeral 1 is a photoreceptor, the numeral 2 is a housing, the numeral 3 is a developing sleeve, the numeral 5 is a developer layer thickness regulating member, the numeral 6 is a member to hold the layer thickness regulating member 6, the numerals 7 and 8 are the first and the second mixers, the numeral 9 is a feed roller, the numeral 10 is a scraper, and the numeral 11 is a partition plate for mixing.

The toner supplied to the apparatus is completely mixed with carrier by the first mixer 7 which rotates in the direction of the arrow mark and the second mixer 8 which rotates in the opposite direction. Then the mixed toner and carrier is fed as the developer 'D' to the developing sleeve 3 through feed roller 9.

The first mixer member 7 and the second mixer 8 are screw type one with counterclock-wise angle which rotate in opposite directions each other. The toner and carrier which are conveyed to the inner part by the thrust of the second mixer 8, get over the partition plate, the upper edge of which is inclined toward the inner part, and move to the first mixer 7. The toner and carrier are conveyed back by its thrust to this side and electrified by friction during the mixing motion of the toner and carrier while they are conveyed. By these processes they become a uniformly electrified developer, and adhere to the spongy feed roller 9 which rotates in the direction of the arrow mark on the drawing. The developer agent attracted to the developing sleeve forms a uniform layer.

The layer of the developer 'D' on the surface of the developing sleeve 3 is conveyed to the developing zone. The thickness of the layer is controlled from 100 μm to 500 μm. preferably it is from 150 μm to 400 μm, and the developer forms a thin layer.

For example, thin developer layer which adheres to the surface of the developing sleeve 3, rotating in the direction of the clockwise arrow mark, develops the latent images on the photoreceptor 1 rotating in the direction of the arrow mark on the drawing in the developing zone without contacting the photoreceptor 1.

Figure 6A:
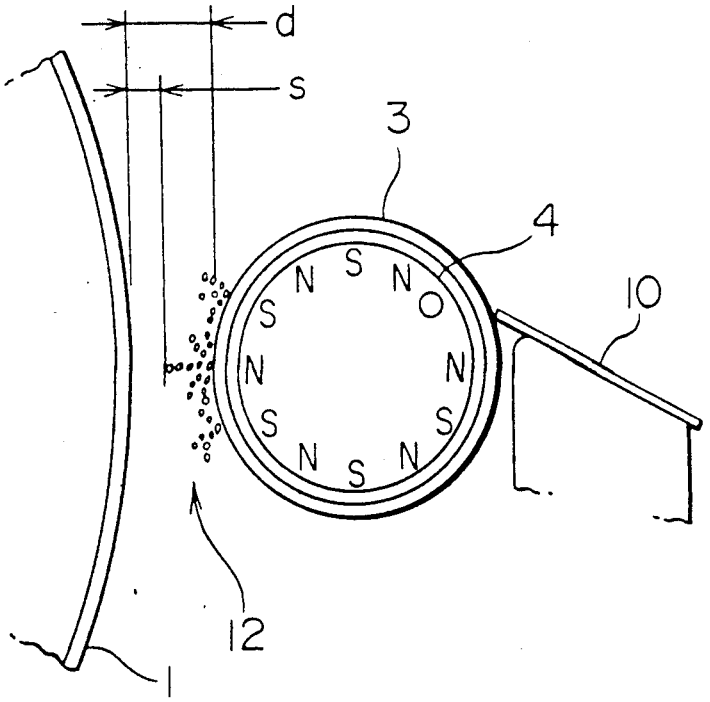
FIG. 6 is a schematic illustration which shows development mechanism between the photoreceptor and the developing sleeve.

The shapes of the developer layer on the surface of the developing sleeve 3 shown in FIG. 6A are formed by the apparatus of FIG. 5A and 5B. The details will be explained as follows. FIG. 6A shows magnetic particle chains of developer layer close to the developing area. If the distance between the developing sleeve 3 and the image carrier 1 is set to 'd', and the height of the chains of the developer is 'S', the condition is $d > S$ in the case of the noncontact developing method.

During noncontact development, a developing bias including an alternating current is given to the developing sleeve 3 by a power source which is not shown in the drawing. As a result, only the toner in the developer on the developing sleeve 3 is selected to be transferred and adheres to the latent image on the photoreceptor surface.

The developer which consumed the toner component has a high carrier percentage after development. It is conveyed by the developing sleeve 3 and scraped off by the scraper 10. Then it is collected and mixed again with the developer which has a high toner concentration.

The following is the specification of the developing apparatus, which is one of the examples of the present invention shown in FIG. 5B.

The developing sleeve 3 is a cylinder of 20 mmϕ diameter which is made from thin stainless steel. The circumferential surface of it is sand blasted and its roughness is 3 μm. The thin cylinder rotates at the speed of from 200 rpm to 300 rpm. In this example, it rotates clockwise at the speed of 250 rpm. The diameter of the developing sleeve is required to be small in order to make the developing apparatus compact, but it is set to be from 15 mmϕ to 30 mmϕ to keep the magnetic attraction force of the built-in magnets over limited value. Various kinds of experiments were made regarding the number of the developing sleeve revolutions. The results were that the less the revolution of the developing sleeve was, the less the amount of the supplied developer was, accordingly the lower the density of the images after development was. As far as the development sleeve of 20 mmϕ outer diameter is concerned, the maximum image density increases linearly when the number of revolutions is from 0 rpm to 200 rpm and the image density does not increase anymore at the speed of more than 200 rpm. But when the environmental temperature is low, the maximum image density decreases, so setting should be conducted making a little allowance for it.

As shown in FIG. 5B, the magnetic roller 4 consists of 12 parts in which the N poles and the S poles are set at the same intervals. But the magnetic roller has 11, one pole being omitted at the point where the developing sleeve comes into contact with the scraper 10 in order to scrape off the developer easily by the repulsive magnetic field. The magnet is installed at a stationary position inside the developing sleeve. It is preferable that the magnetic attraction of each magnet is big enough to prevent the carrier from adhering to the image carrier 1, but because of space limitations depending on the shape of the magnet, too great a magnetic attraction is not practical. Usually magnetic induction is kept at from 500 gauss to 700 gauss on the surface of the developing sleeve 3. In this example, it is kept at 600 gauss. The magnetic roll 4 is made from ferrite.

After the experiments were made using the developer layer thickness regulating member, it was confirmed that excellent images with high quality were obtained, in which problems were not found such as white streaks due to developer aggregation, sticking of toner to the the developer layer thickness regulating member, degraded image quality, and so forth.

It can be seen from this example that the important factors to determine the amount of developer conveyance are the radius of curvature of the regulating member at the pressing area onto the developing sleeve, and its pressure against the developing sleeve. Accordingly, various examples to provide radius of curvature and pressure are shown in the drawings, from FIG. 7A to FIG. 13A.

Figure 7A:
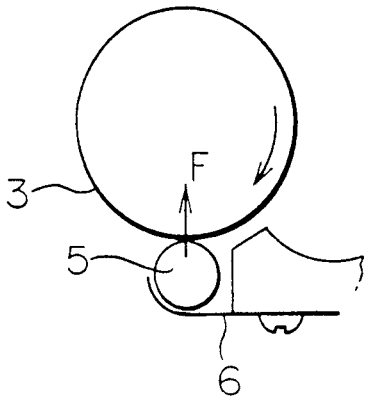
FIG. 7, 8, 9, 10, 11, 12, and 13 are partial diagrammatic views of another examples of the embodiment shown in FIG. 5.

The example in FIG. 7A shows that the cylindrical bar is pressed by a spring plate. The examples in FIG. 8A and FIG. 8A(*b*) show that the spring plate pressure can be partially adjusted. In this case, various type of plate spring can be used such as a one body flat spring, a partially slit flat spring, and completely split flat springs.

Figure 9A:
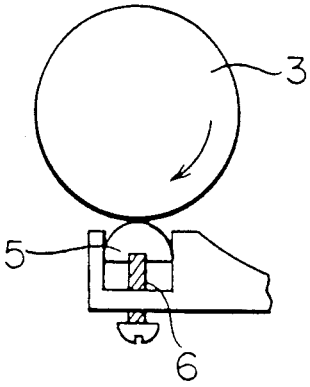

FIG. 9A shows an example in which a coil spring is used instead of a spring plate to provide pressure. In the case of using a coil spring, a plurality of springs are used, arranged in the direction of the axis of the cylindrical bar to obtain the desired pressure.

Figure 10A:
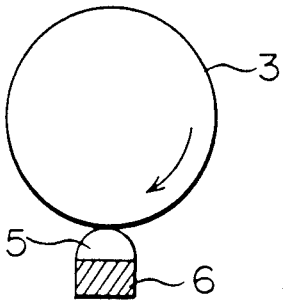

FIG. 10A shows an example in which a compressed rubber type elastic body 6 is used to obtain the desired pressure when it is compressed. Not only a rubber type elastic body, but also a resin foam can be in practical use.

Figure 11A:
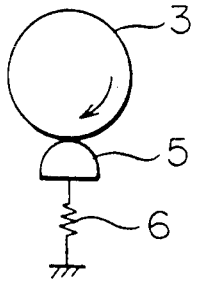

FIG. 11A shows an example in which a semicylindrical body is used to press the cylindrical bar.

Figure 12A:
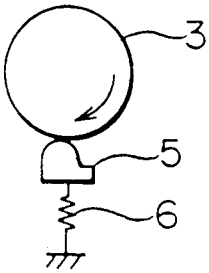

FIG. 12A shows an example in which a layer thickness regulator with an edge portion is used. By this edge, the thickness of the developer layer is controlled to the prescribed thickness. Normal synthetic resins with rigidity and metals can be used without any problems as the materials of the head portion shown in FIG. 11A and FIG. 12A.

Figure 13A:
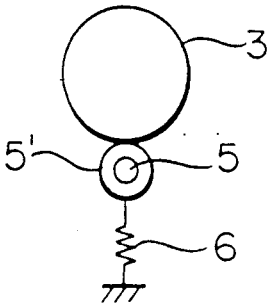
Figure 13A:
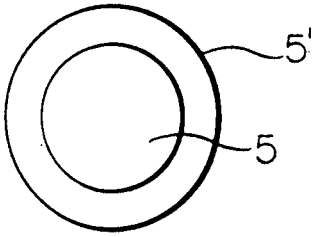

FIG. 13A shows an example in which the head portion of the layer thickness regulator consists of two layers. It is covered with thin urethane rubber or silicon rubber layer. It is preferable that the core 'S' is covered by a rubber sheet 5', the thickness of which is from 0.01 mm to 1 mm.

The developer amount regulating member which is made from magnetic materials is also practiced in this invention.

Figure 5C:
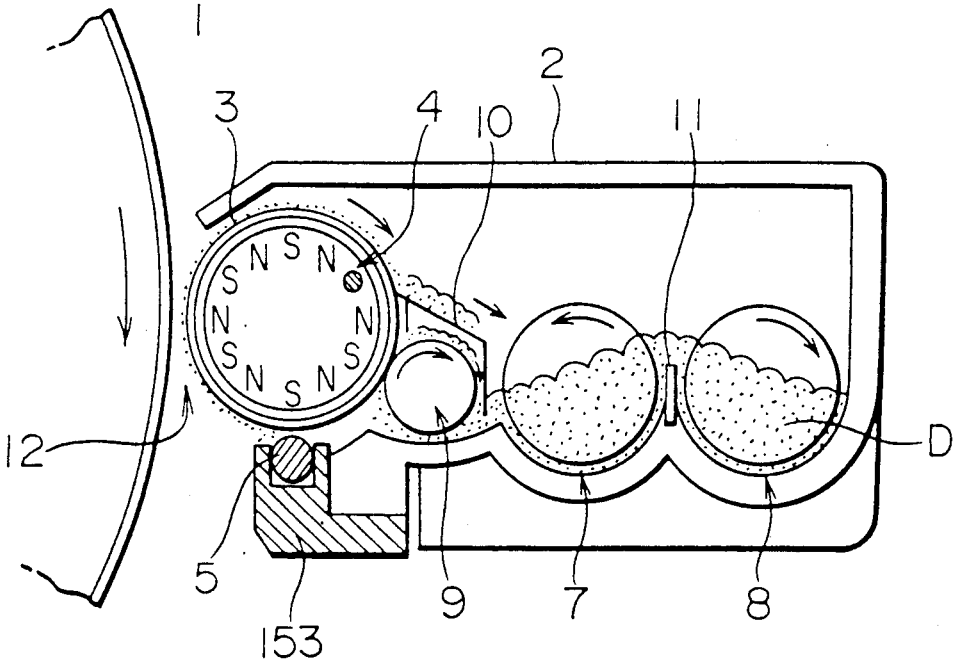
Figure 5D:
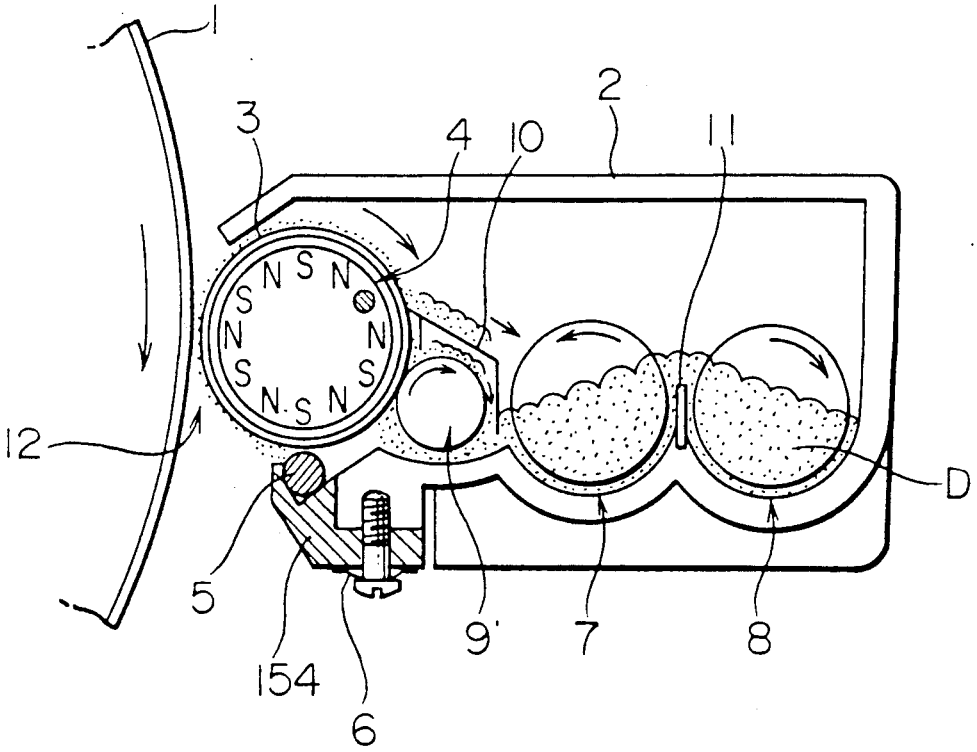
Figure 5E:
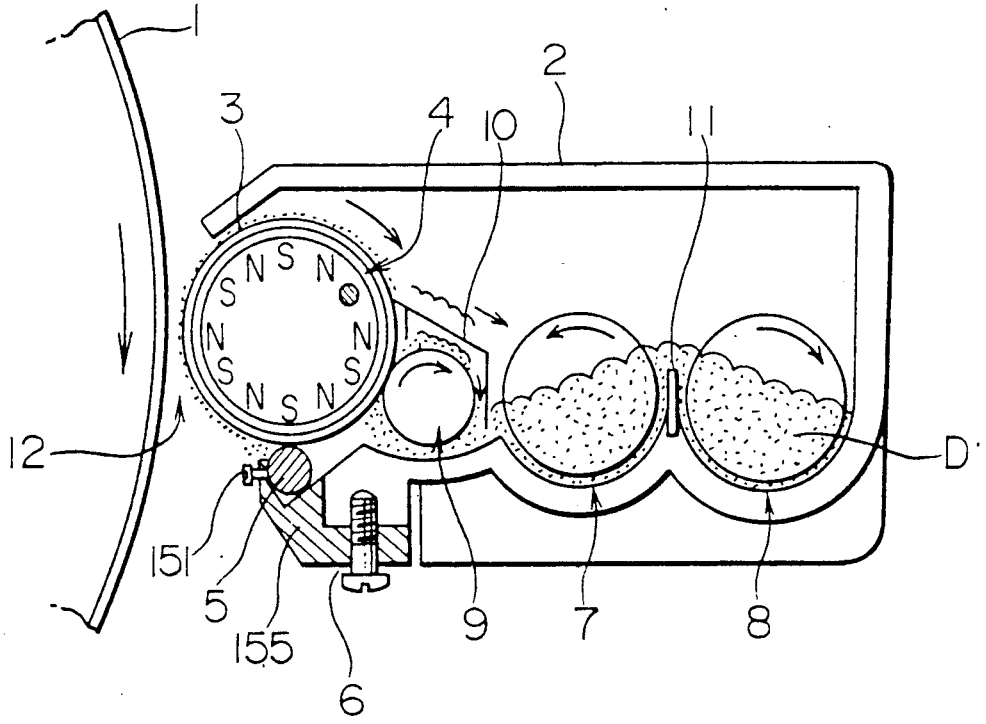

FIG. 5D is a sectional view of the main portion of the developing apparatus. The numeral 1 represents an image carrier, the numeral 2 represents a housing, the numeral 3 represents a developing sleeve, the numeral 4 represents a magnetic roller, the numeral 5 represents a cylindrical bar with rigidity and magnetism for controling the amount of the developer, the numeral 154 represents a holder which holds the cylindrical bar 5, the numeral 6 represents a spring which presses the cylindrical bar 5 against the developing sleeve 3 to convey the developer, wherein the cylindrical bar 5 is pressed to the developing sleeve 3 with a constant pressure or with the magnetic attraction as shown in FIG. 5C in the condition that the developer does not exist there, the numerals 7 and 8 represent the first and second mixers, the numeral 9 represents a feed roller, the numeral 10 represents a scraper, and the numeral 11 represents a partition for mixing.

The toner supplied to the apparatus is completely stirred and mixed with the carrier by the first mixer 7 and the second mixer 8, which rotates in the opposite direction of the first mixer, and conveyed as the developer 'D' to the developing sleeve 3 through the feed roller 9.

The first mixer 7 and the second mixer 8 are screw-shaped members with counterclockwise spirals and rotate in the opposite direction to each other as shown by the arrow marks in the drawing. The toner and the carrier are conveyed to the inner part by the thrust of the second mixer 8. The toner and carrier which were conveyed to the inner part get over the partition 11, the upper edge of which is inclined to the inner part. They move to the first mixer 7 in this way and are conveyed to this side by the thrust of it. While the toner and carrier are stirred and mixed, they are electrified by friction and become a uniform developer 'D'. Then the developer is conveyed to the developing sleeve by the spongy feed roller 9 which rotates in the direction of the arrow mark. Finally, the developer adheres on the circumferential surface of the developing sleeve 3 in a layer, supplied by the feed roller 9.

The details of the developer which was used in the example of FIG. 5D is shown in table I as well as the details shown for the first embodiment.

Figure 19:
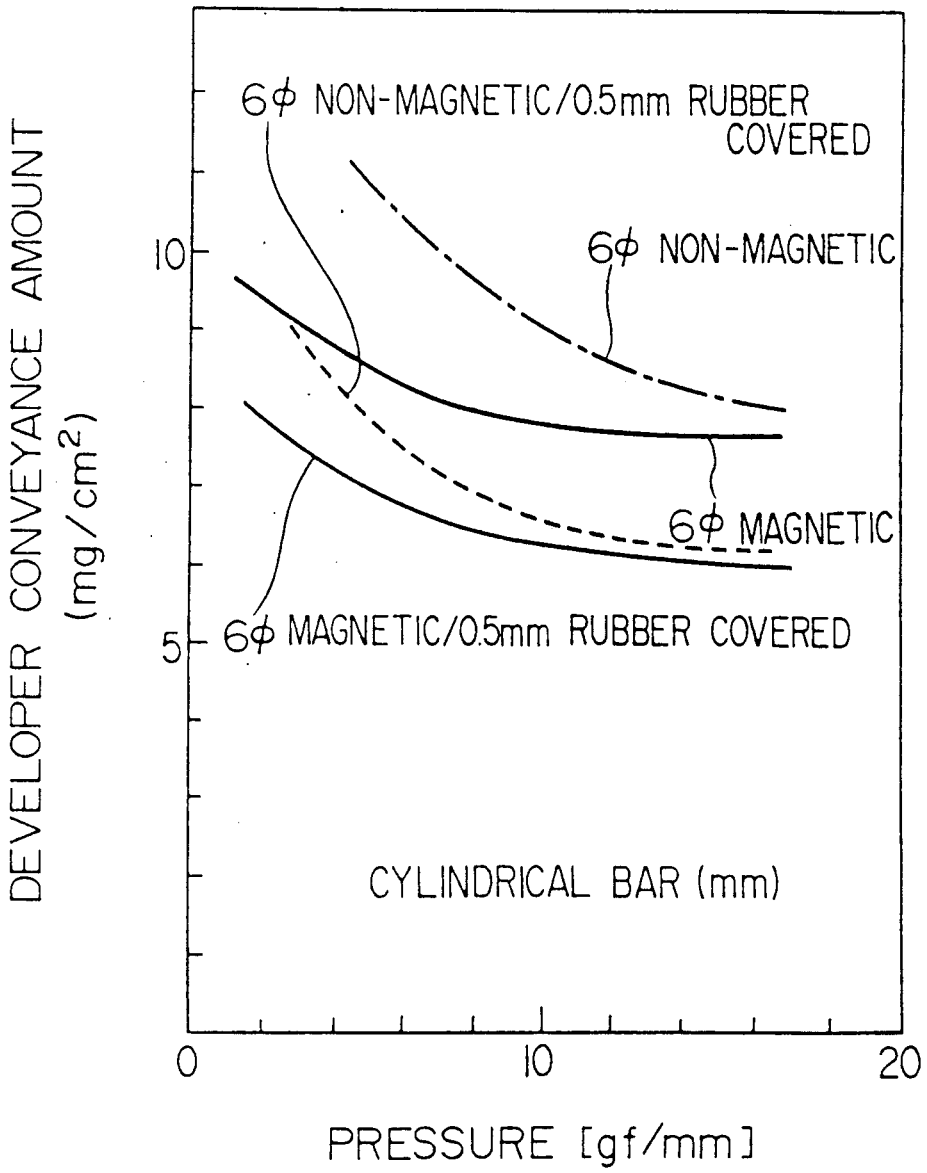

In this apparatus, the diameter of the cylindrical bar 5 is 6 mm$\phi$ and is made of stainless steel with rigidity and magnetism. This stainless steel is defined as SUS by Japanese Industrial Standards. This cylindrical bar was set at the position which faced the pole of the magnet roller 4 with the pressure from 2 gf/mm to 6 gf/mm. As the result, a uniform amount of conveyance from 7 mg/cm$^2$ to 9 mg/cm$^2$ was obtained. The result was that uniform image with even density was obtained. When this experiment was conducted, the flux density at the pressure point on the developing sleeve 3 was 600 gauss. FIG. 19 represents the results of the comparison of the conveyance amount of the developer between when the magnetic cylindrical bar 5 and a rigid nonmagnetic 6 $\phi$mm cylindrical bar.

Figure 18B:
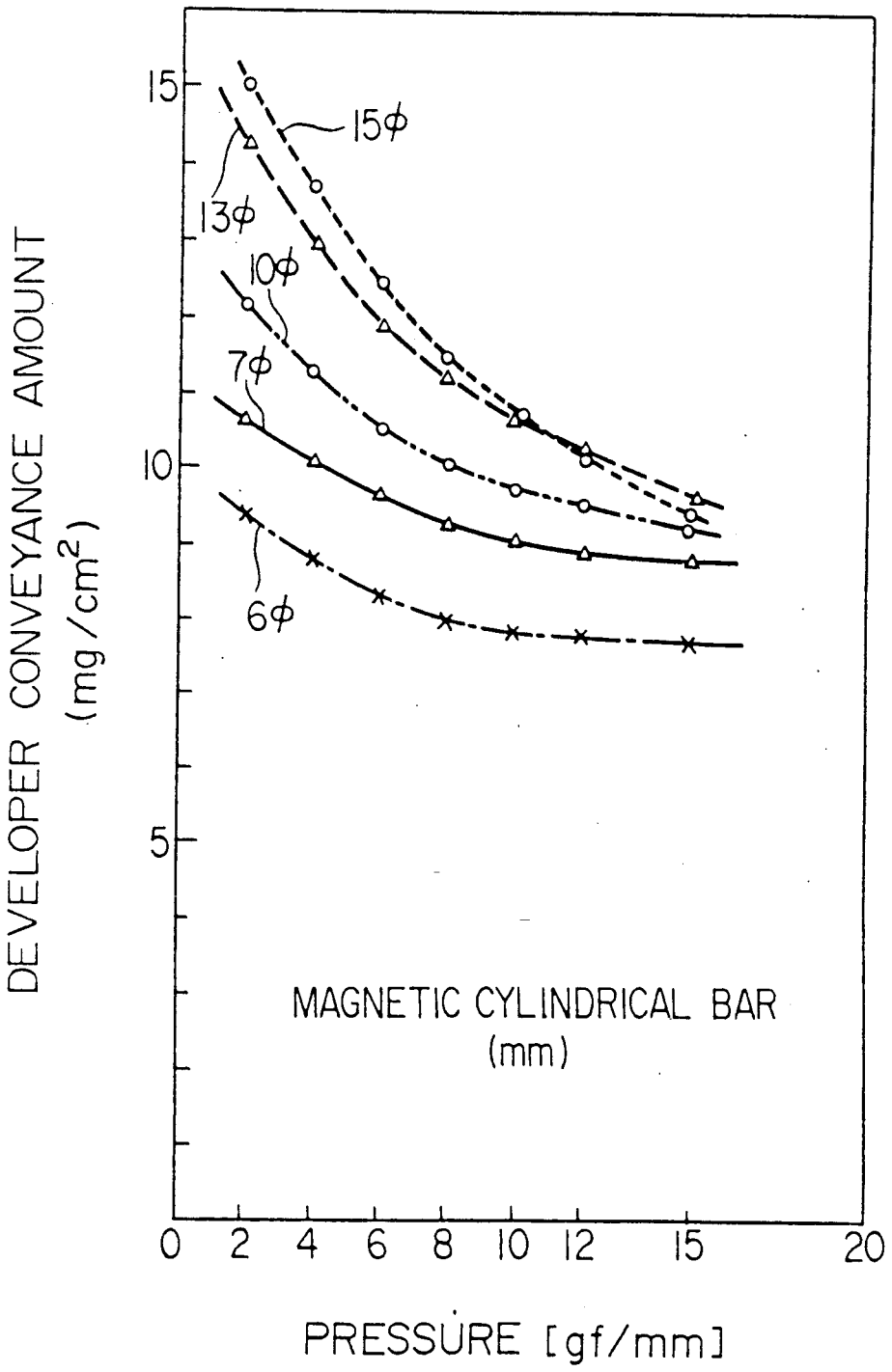

The conveyed amount of developer when a cylindrical bar with both rigidity and magnetism is used, is shown in FIG. 18B. As shown in the drawing, the relation is represented between the pressure and the conveyance amount when the diameter of the magnetic cylindrical bar is changed. The appropriate conveyed amount can he chosen from this graph. Especially, in the case that the radius of curvature was from 0.5 mm to 15 mm, good valance in the force between the developer 'D' to the cylindrical bar 5 and the cylindrical bar to the sleeve, is obtained, and a stable conveyance amount was obtained. Furthermore, a better result was obtained in the case that the radius of curvature was from 1 mm to 10 mm, the conveyance amount varied very little and a uniform thin developer layer was obtained in spite of fluctuation of the pressure.

Although nonmagnetic stainless steel was used as the material of the rigid developing sleeve 3 in this example, rigid materials such as aluminum or other metals, hard resin, glass, ceramics, and so forth were used and the same good results were obtained. The roughness of the developing sleeve 3 surface was '3S'. Materials of roughness from '0.1S to '20S' were used in the experiments and the same good results were obtained.

According to the explanation above, in order to obtain high quality images, it is preferable to form a stable and thin developer layer thickness of from 100 $\mu$m to 450 $\mu$m on the developing sleeve. It is furthermore preferable to form a developer layer of thickness from 150 $\mu$m to 400 $\mu$m.

The structure of this example will be explained as follows.

The developer layer which is formed on the circumferential surface of the developing sleeve 3 equipped with the stationary magnetic roller 4 inside, wherein the developing sleeve rotates in the direction of the arrow mark, clockwise as shown in the drawing, develops the latent images on the image carrier 1 with a gap between the developing sleeve 3 and the photoreceptor 1 without any contact of the two rollers. Toner images are formed by this method.

Figure 6B:
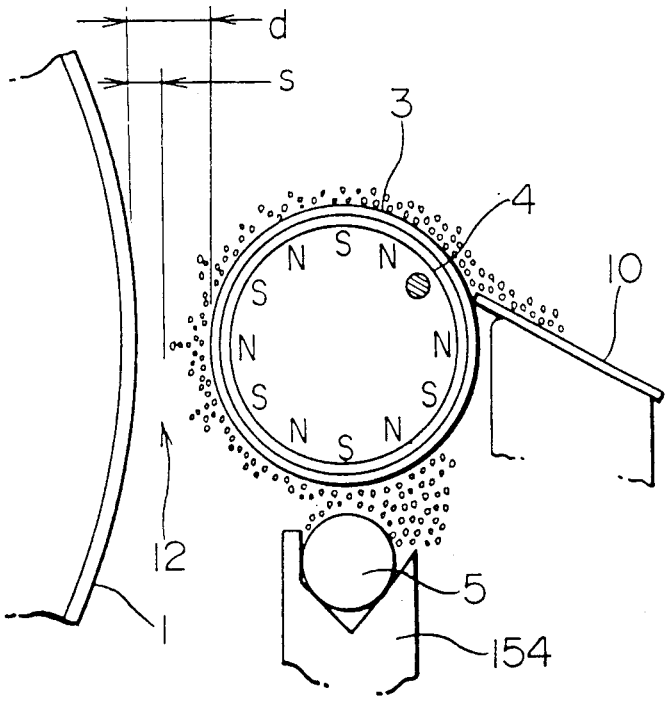

The shapes of the developer layer on the surface of the developing sleeve 3 of FIG. 6B are formed by the apparatus of FIG. 5D. The details will be explained as follows. FIG. 6(*b*) shows magnetic particle chains of developer layer close to the developing area. If the distance between the developing sleeve 3 and the photoreceptor 1 is set to 'd', and the height of the chains of the developer is 'S', the condition is $d > S$ in the case of a noncontact developing method.

During the noncontact development, a developing bias including an alternating current is impressed to the developing sleeve 3 by a power source which is not shown in the drawing. As a result, only the toner in the developer on the developing sleeve 3 is selected to be transferred and adheres to the latent surface.

The developer in which the toner component has been consumed has a high carrier percentage. It is conveyed by the developing sleeve 3 and scraped off by the scraper 10. Then it is collected and mixed again with the developer which has a high toner percentage.

The following is the specification of the developing apparatus, which is one of the examples of the present invention, shown in FIG. 5D.

The developing sleeve 3 is a cylinder of 20 mm$\phi$ diameter which is made from thin stainless steel. The circumferential surface of it is sand blasted and the roughness of it is 3 $\mu$m. The thin cylinder rotates at the speed of from 200 rpm to 300 rpm. In this example, it rotates clockwise at the speed of 250 rpm. The diameter of the developing sleeve 3 is required to be small in order to make the developing apparatus compact, but it is set to be from 15 mm$\phi$ to 30 mm$\phi$ because the magnetic attraction of the built-in magnets is limited. Various kinds of experiments were made in the revolution number of the developing sleeve. The results were that the less revolutions of the developing sleeve, the less the amount of the supplied developer was, accordingly the lower the density of the images after development was. As far as the development sleeve of 20 mm$\phi$ outer diameter is concerned, the maximum image density increases linearly while the number of revolutions is from 0 rpm to 200 rpm and the image density does not increase anymore at the speed of more than 200 rpm. But when the environmental temperature is low, the maximum image density decreases, so setting should be conducted making a little allowance for it.

As shown in FIG. 5D, the allocation of magnet pole on the magnetic roller 4 consists of 12 equal parts in which the N poles and the S poles are set at the same intervals. But the magnetic roller has 11 poles because one of the poles is omitted at the point where the developing sleeve comes into contact with the scraper 10 in order to scrape off the developer easily in the repulsive magnetic field. The magnet is installed at a stationary position inside the developing sleeve. It is preferable that the magnetic attraction of each magnet is big enough to prevent the carrier from adhering to the image carrier 1, but because of space limitations depending on the shape of the magnet, too big magnetic attraction is not practical. Usually the maximum magnetic induction is kept from to be from 500 gauss to 700 gauss on the surface of the developing sleeve 3. In this example, it is kept to be 600 gauss. The magnetic roll 4 is made from ferrite.

The relation in the position between the developing sleeve 3 and the cylindrical bar 5 is shown in FIG. 6B. The cylindrical bar 5 is pressed to the developing sleeve 3 at the position where the cylindrical bar faces a pole of the magnetic roller 4, and the cylindrical bar is attracted to the magnetic roller by magnetic attraction. As a result, the pressing force is increased so that the cylindrical bar sticks uniformly to the developing sleeve.

In the example explained above, a cylindrical bar with rigidity and magnetism was used as the developer layer thickness regulating member. It was confirmed that high quality images were obtained without any white streaks caused by developer aggregation on the images, sticking of toner to the developer layer thickness regulator during continuous copying and any degradation of image quality. It was also confirmed that a magnetic cylindrical bar is superior to a nonmagnetic one in the effects mentioned-above. The magnetic cylindrical bar can be either a bar which is attracted to the developing sleeve 3 by induced magnetism in the bar or one which is attracted by magnetic materials.

It can be seen from this example that the most important factors are the radius of curvature of the cylindrical bar and the pressure of the bar against the developing sleeve in order to determine the developer conveyance amount when a rigid and magnetic cylindrical bar is used a the developer conveyance amount regulator. Accordingly, various kinds of examples of developer layer thickness regulator and their radius of curvature and pressure are shown in the drawings from FIG. 7B to FIG. 13B.

Figure 7B:
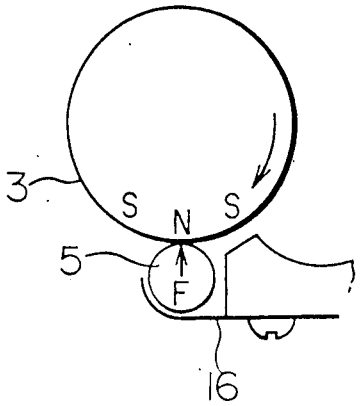
Figure 7C:
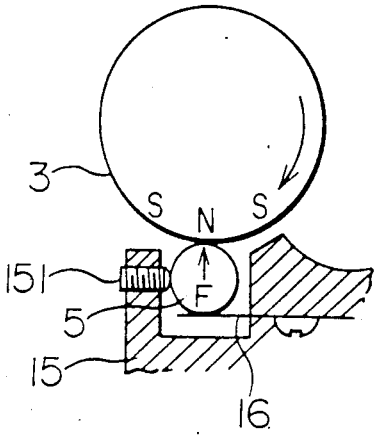
Figure 8A:
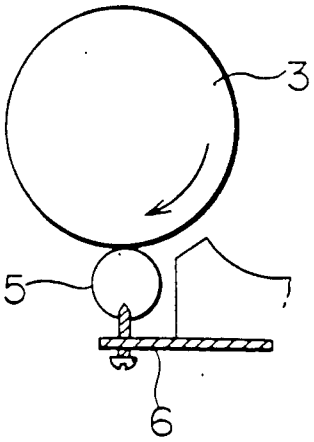
Figure 8A:
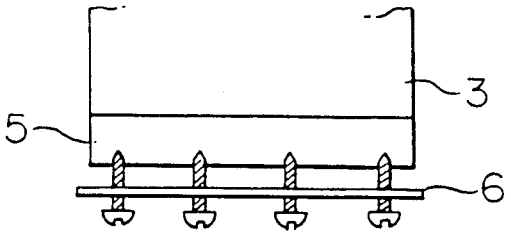
Figure 8B:
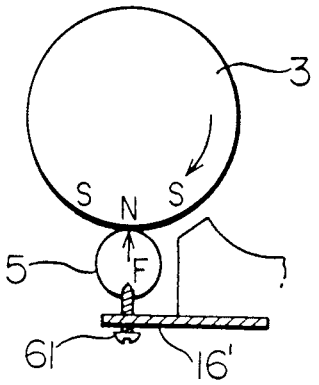
Figure 8B:
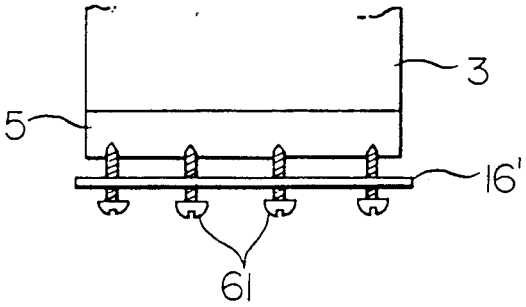
Figure 8C:
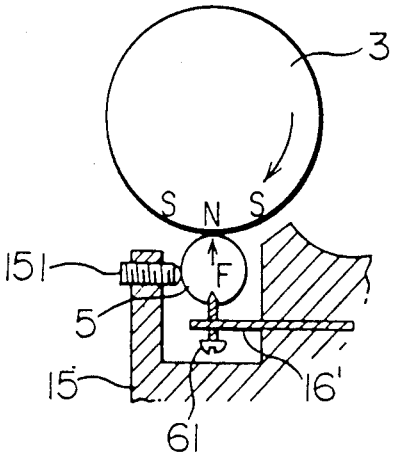
Figure 8C:
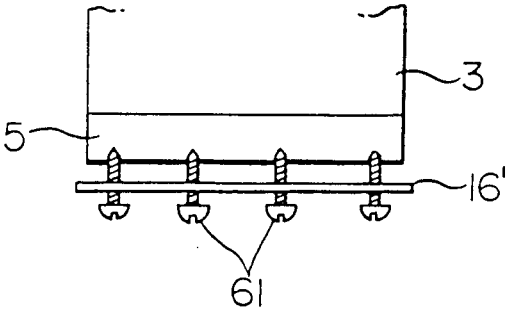

FIG. 7B shows an example in which the flat spring 16 holds the cylindrical bar 5 and the bar presses the developing sleeve. FIGS. 8B(*a*) and (*b*) show an example in which the pressure of the flat spring 16' is partially adjusted by the adjusting screws 61. Various shapes of flat springs can be used successfully in this example, such as a flat spring 16' which is one body, a flat spring which is partially slit, and a flat spring which is completely slit. In this case, the direction of the slit makes a right angle with the center line of the cylindrical bar.

Figure 9B:
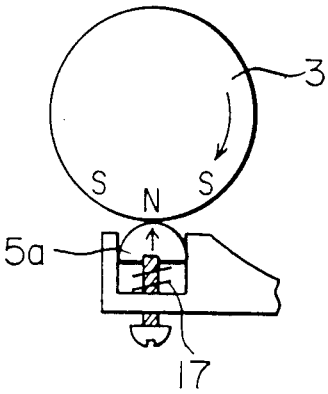
Figure 9C:
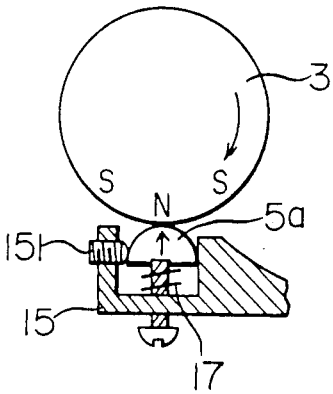

FIG. 9B is an example in which the pressure against the developing sleeve is given by coil springs 17. As shown in FIG. 9B, a bar 5*a*, the section of which is semicircular, is used and plural coil springs 17 are installed in the direction of the semicircular bar to obtain the desired pressure.

Figure 10B:
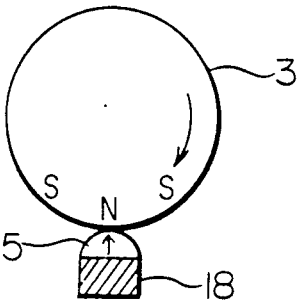
Figure 10C:
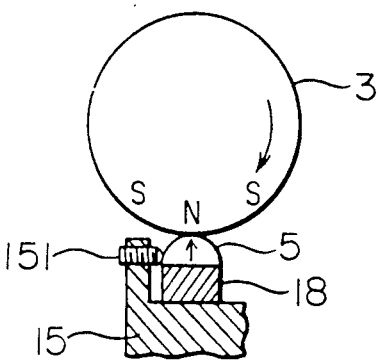

FIG. 10B is an example in which an elastic body 18 such as rubber is compressed to get the necessary pressure. Not only an elastic body like rubber, but also resin foam can be used.

Figure 11B:
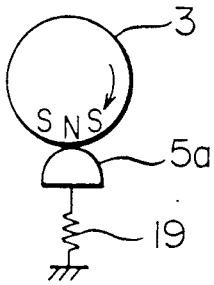
Figure 11C:
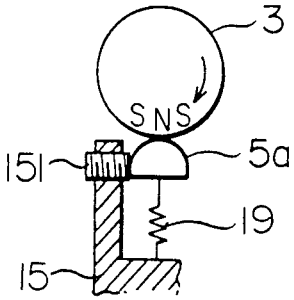

FIG. 11B is an example in which the semicircular bar 5*a* is used in the same way as in FIG. 9B and FIG. 10B and the bar is pressed by the compressed spring 19.

Figure 12B:
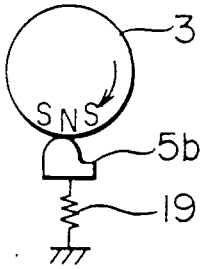
Figure 12C:
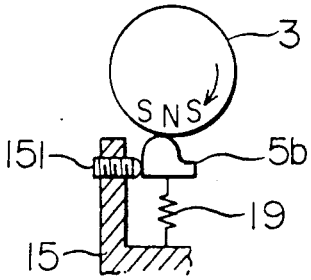

FIG. 12B is an example in which the pressing member 5*b* is rigid and magnetic and it has a radius of 6 mm. The edge portion 5*b* is installed at the position of the upper stream of the pressing member and the thickness of developer is controlled to become the prescribed one. The bars shown in FIG. 11B and FIG. 12B are made from materials with rigidity and magnetism and press the position on the developing sleeve which faces a magnetic pole or close to them. That is the reason there is no problem at all in the practical use of them.

Figure 13B:
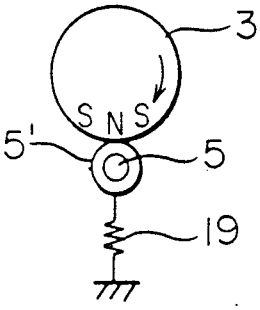
Figure 13C:
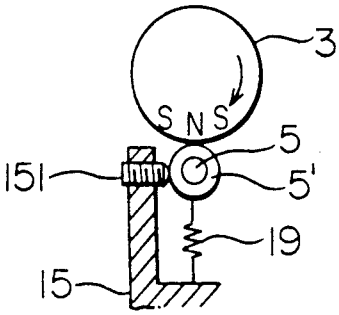

FIG. 13B is an example in which the bar consists of two layers. The outside of the cylindrical bar 5 is covered with a thin rubber layer 5' made from urethane rubber or silicon rubber.

It is preferable that the thickness of the rubber sheet which covers the bar of the developer conveyance amount regulator is from 0.01 mm to 1 mm.

Figure 6C:
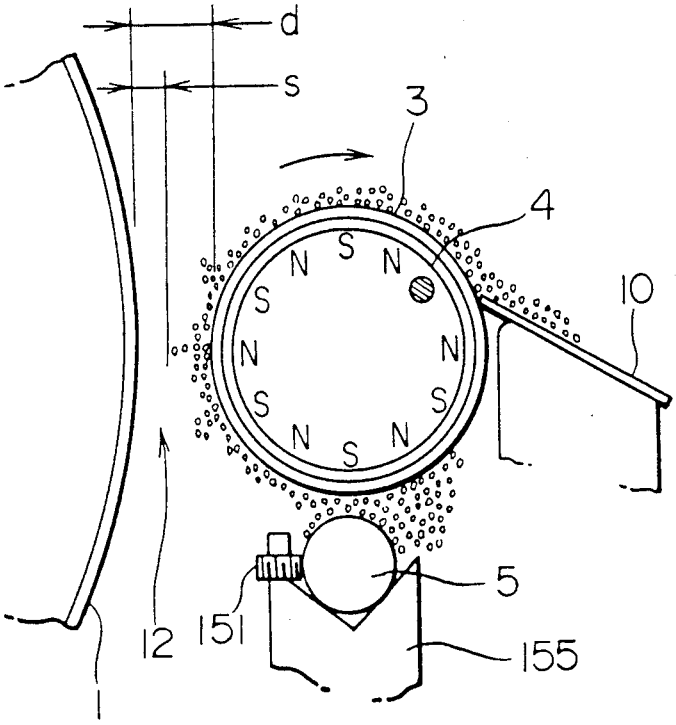

In the first and the second embodiments, the relation between the developing sleeve 3 and the cylindrical bar 5 is explained referring to FIG. 6C. The position adjusting member 151 is installed at the holder 155 which holds the cylindrical bar 5. The adjusting member is set in the downstream of the developing sleeve 3. The developing sleeve 3 can be kept parallel with the cylindrical bar 5 by fine adjustment of the position adjusting member 151. In this example, the position adjustment member 151 consists of two sets of tapped holes and small screws, with the round shaped top, in the length wise direction of the cylindrical bar 5. The posture and position of the cylindrical bar are controlled by pushing the cylindrical bar 5 with the spherical portion of the screw of the adjusting member 151. After being adjusted by the small screws, the screws are fixed by the adhesive agent such as screw-locking. Stainless steel is the material of the small screw. If the hardness of the cylindrical bar surface is high, it is preferable to use very hard materials, such as ruby, for the spherical portion of the tip of the small screw.

Fine adjustment screws which are shown in examples FIG. 7B to 13B can be also installed in examples FIG. 7C to FIG. 13C in order to keep the developing sleeve 3 axis parallel with the cylindrical bar 5 or 5*a* axis. Thus, it becomes easier to accomplish the predetermined cylindricity and straightness of the cylindrical bar.

Figure 16A:
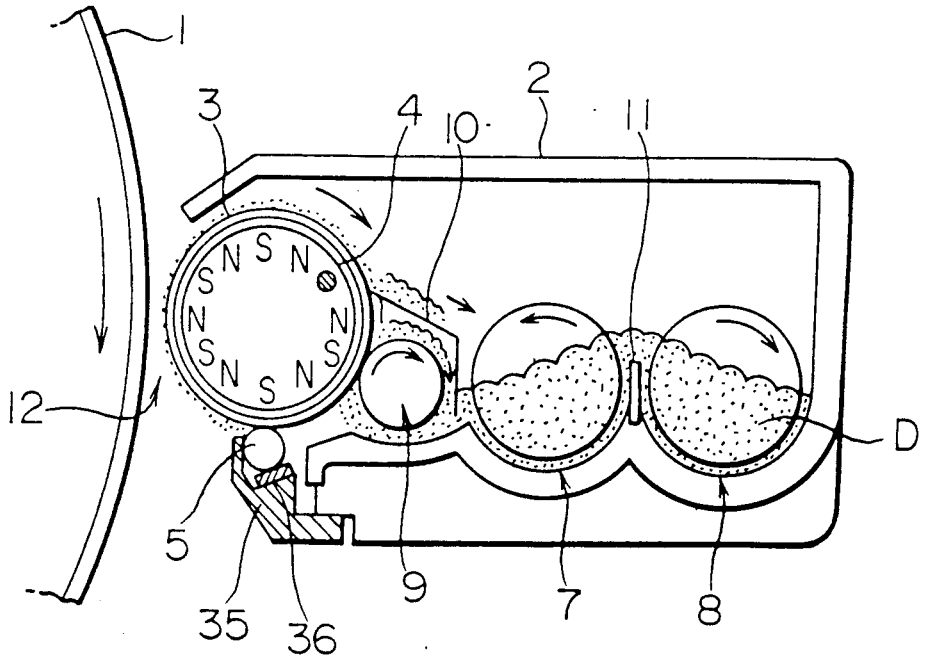
FIG. 16 is a schematic illustration of an example in which a nonlinear elastic body is used as the pressing member.

FIG. 16A is a sectional view of the main portion of an embodiment of the invention which comprises non-linear elastic body as the pressing member. In the case where a thin layer is to be formed by using two component type developer, as factors in addition to rigidity and curvature of cylindrical bar and pressing force as mentioned above, the inventors have learned that uniformity of pressing force and relative relation in roughness between surfaces of the cylindrical bar and the developing sleeve greatly contribute to obtain a uniformly thin layer. The numerals of portions of this drawing are the same as those shown in FIG. 5D when the functions of the portions are common.

The developing sleeve 3 is a cylinder made from nonmagnetic stainless steel rotating at the speed of 250 rpm in the direction of the arrow mark on the drawing. Its diameter is 20 ϕmm and the roughness of its surface is '3 S', as it was sand blasted. The stationary magnet roller 4 with eleven magnetic poles is installed inside the developing sleeve 3. The maximum magnetic flux density on the surface of the developing sleeve is kept at 600 gauss.

Figure 15:
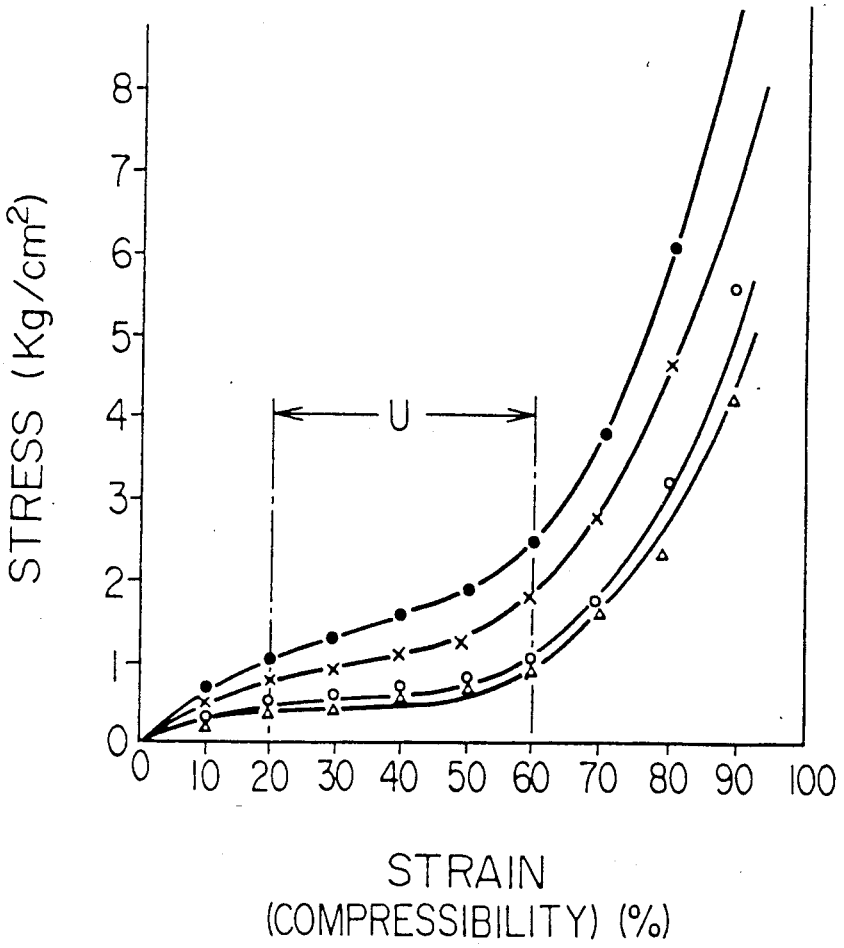
FIG. 15 is a graph which represents the relation between deflection and load of a nonlinear elastic body.
Figure 17A:
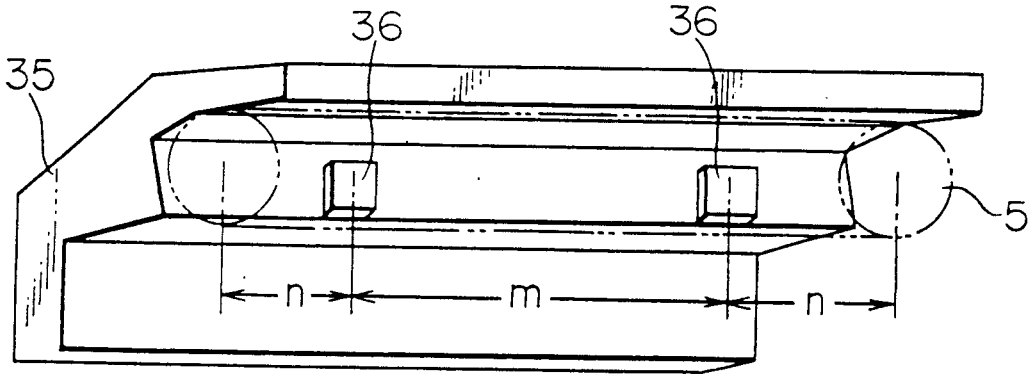
FIG. 17 is a perspective view of the main portion of the example shown in FIG. 16.

The cylindrical bar with rigidity and magnetism is pressed to the developing sleeve 3 at the position where the cylindrical bar faces a magnetic pole of the magnetic roller 4. The cylindrical bar 5 is completely straight and its diameter is 6 ϕmm. It is made from stainless steel which is defined as SUS 416 by Japanese Industrial Standards. The roughness of its surface is '0.5 S' since it was processed by a grinder. Its surface is not coated. The cylindrical bar 5 is prevented from moving to the side by the holder 35 which is installed in the housing 2 and pressed to the developing sleeve 3 by the nonlinear elastic body 36. The nonlinear elastic body used in this example has the characteristics in which the fluctuation of repulsion to deflection is little in the operating range. PORON, one of the brands manufactured by INOAC Co., was used in this example and its characteristics are shown in FIG. 15. In this example, two pieces of nonlinear elastic body 36 which are rectangular sheets 2 mm thick. 4 mm wide and 5 mm long, are adhered to the holder 35, and press the cylindrical bar 5. FIG. 17A shows how the nonlinear elastic body 36 is installed in the holder 35. As shown in the drawing, the cylindrical bar is pressed by the elastic body at the two points which divide the cylindrical bar length in a ratio of n:m:n=2:5:2. When the pressure ranging from 2 gf/mm to 4 gf/mm was set to the apparatus, the cylindrical bar deflection caused by the pressure was decreased and the two-component developer which was regulated to the amount ranging from 7 mg/cm$^2$ to 10 mg/cm$^2$ in the direction of the developing sleeve axis, was conveyed. In this example, the developer conveyance amount regulating device was not installed. Nevertheless, the good development condition mentioned above was able to be set and maintained.

As far as nonlinear elastic body 36 is concerned, other materials can be used such as 'PORON' which is urethane foam, 'SORBOTHANE' which is one of the brands manufactured by SANSHIN KOSAN Co., α-gel, moltplane, a nonlinear spring, and so forth.

Concerning the method by which nonlinear elastic body 36 presses the cylindrical bar, the above-mentioned two point support pressing method was effective to reduce the deflection of the cylindrical bar 5, and multiple point support and continuous support are also available. But, when these pressing methods are adopted, extreme attention should be given to the parallel accuracy of holder 35.

In the above-mentioned example, the roughness of the developing sleeve surface was '3 S' and that of the cylindrical bar surface was '0.5 S'. It is desirable that the roughness of the cylindrical bar surface is less than '0.5 S' with specular gloss. On the other hand, the roughness of the developing sleeve surface needs to be rough in order to convey the necessary amount of developer. It is preferable that the roughness of the developing sleeve surface is rougher than that of the cylindrical bar surface.

On the above roughness condition, when carrier particles attracting thereon toner particles being fully charged by the work of agitation in the developing device are pressed on the developing sleeve by the cylindrical bar, frictional force between carrier particle and the cylindrical bar having high finish surface and small curvature radius is smaller than that between carrier particle and the developing sleeve having rough finish surface and large curvature radius. Accordingly, carrier particles roll on along the surface of the cylindrical bar and then pass through between the cylindrical bar and the developing sleeve so that a preferable thin layer having a thickness corresponding to a diameter of carrier particle can be formed.

When used for a long time, the developing sleeve surface becomes smooth. As a result, the developer conveyance amount tends to gradually decrease. According to the results of experiments, it is preferable that the surface of the cylidrical bar is as hard as that of the developing sleeve.

Figure 16B:
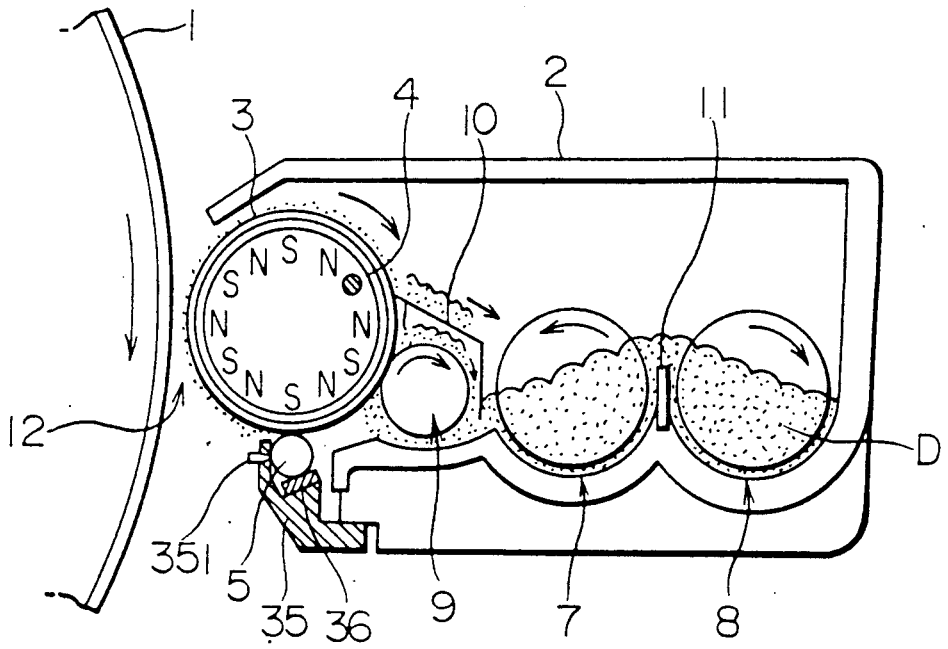
Figure 17B:
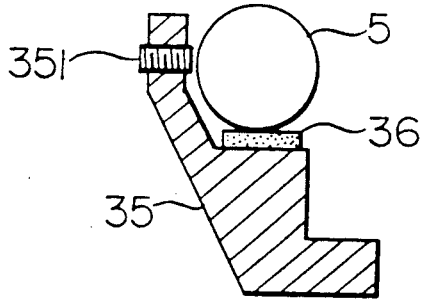
Figure 17B:
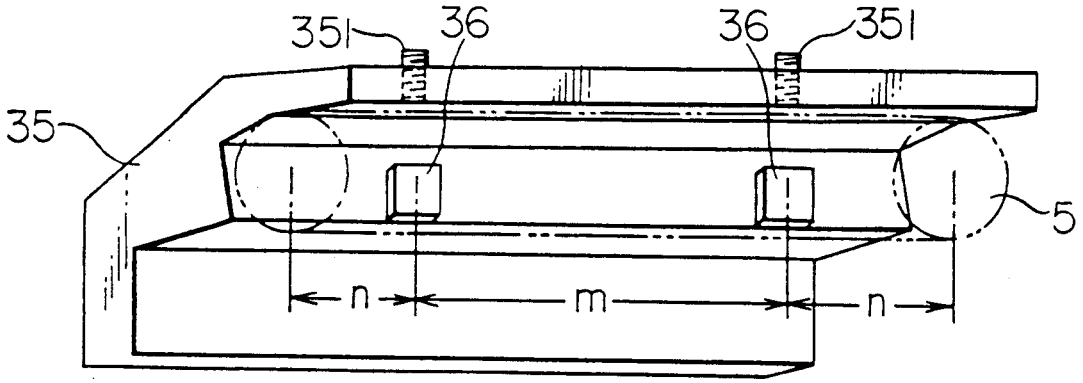

In this example, two small adjusting screws 351 can be used to adjust the relative position of the cylindrical bar 5 to the holder 35 as shown in FIG. 16B and FIG. 17B. The tip of the small adjusting screw comes into contact with the cylindrical bar 5 and controls the relative position of the cylindrical bar 5 to the developing sleeve 3.

Figure 6D:
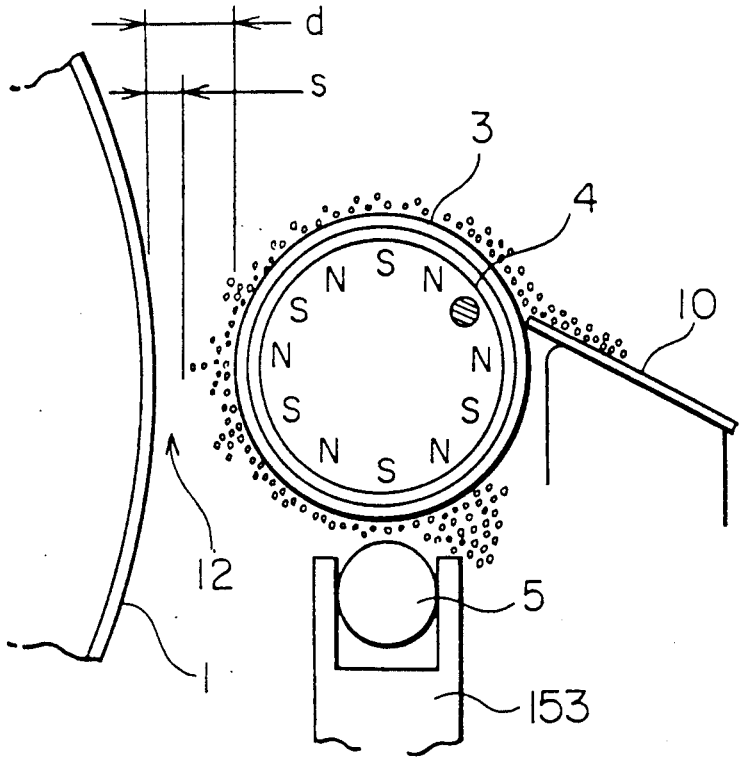

The embodiment which presses the cylindrical bar onto the developing sleeve without using any spring means, but using merely a magnetic force is described hereafter. The relation in the position between the developing sleeve 3 and the cylindrical bar 5 is shown in FIG. 6D. The cylindrical bar 5, magnetized or magnetically induced, is pressed to the developing sleeve 3 at the position where the cylindrical bar faces a pole of the magnetic roller 4, and the cylindrical bar is attracted each other to the magnetic roller by magnetic attraction without any spring pressure. As a result, the pressing force is increased so that the cylindrical bar sticks uniformly to the developing sleeve.

In this example, in which the cylindrical bar 5 with rigidity and magnetism was used as the developer layer thickness regulating member, it was confirmed that reliable and excellent images could be obtained without causing any white streaks caused by the aggregation of the developing agent, any sticking of toner to the layer thickness regulating member during continuous copying and any degradation in image quality. As mentioned before, the cylindrical bar can be either one which is induced and attracted to the developing sleeve 3 or one which is magnetized and attracted to the developing sleeve.

In this example, the most important factor in the determination of the conveyance amount of developer by the developer amount regulating member with rigidity and magnetism which is pressed to the developing sleeve is the pressing force owing to the radius of curvature of the regulating member and the magnetic attraction as far as a cylindrical bar with rigidity and magnetism is used.

Figure 7D:
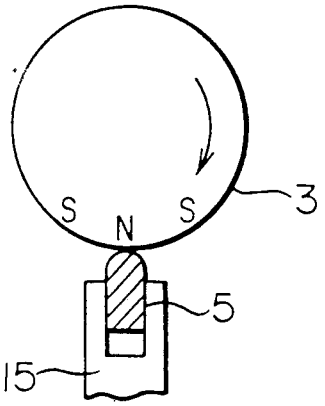
Figure 8D:
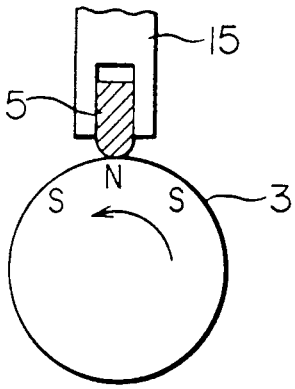

FIG. 6D is an example which shows that the cylindrical bar 5 is held by the holder 153 and it can rotate freely. FIG. 7D and 8D show examples in which the cylindrical bar 5 can move only in the direction of the developing sleeve and can not rotate. FIG. 7D is an example in which the pressure is the magnetic attraction from which the weight of the cylindrical bar 5 is deducted. FIG. 8D shows an example in which the pressure is the addition of the magnetic attraction and the weight of the bar. In this example, fine adjustment of the pressure is possible by designing the sectional shape of the bar 5 appropriately.

FIG. 8D shows an example in which the rotating direction of the developing sleeve 3 is opposite to that of the example shown in FIG. 7D.

Figure 9D:
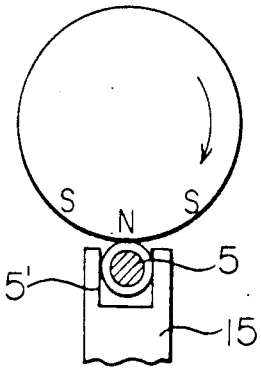

FIG. 9D shows an example in which the bar consists of two layers. The outside of the cylindrical bar is covered with a thin rubber sheet 5' such as urethane rubber, silicon rubber and so forth. In this case, it is preferable that the thickness of rubber sheet which covers the pressing portion of the developer amount regulator is from 0.01 mm to 1 mm. If the rubber 5' is too thick, the pressure due to the magnetic attraction falls suddenly.

Figure 14A:
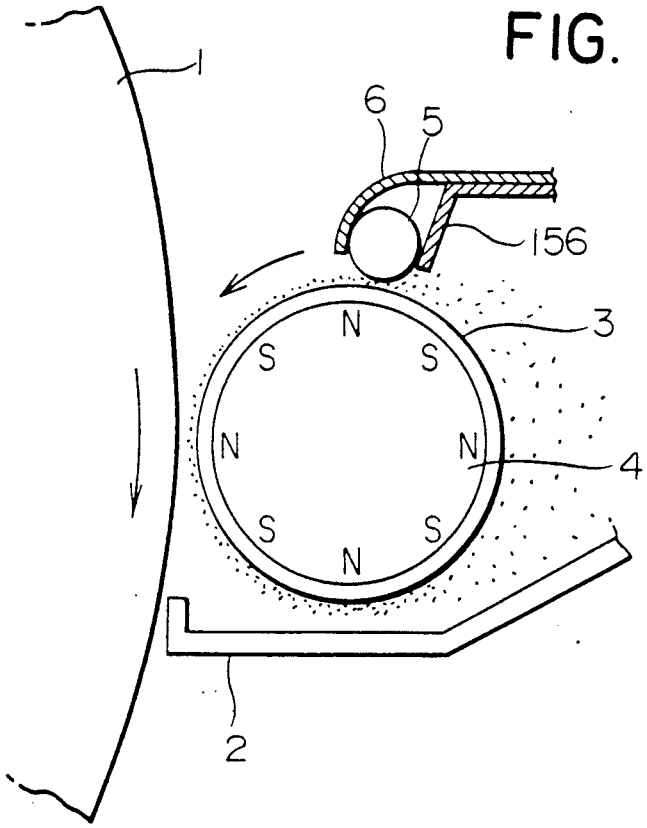
FIG. 14 is a schematic illustration of an example in the case that the developing sleeve is rotated in the same direction as the photoreceptor.

The third embodiment of the invention has almost the same structure as the example shown in FIG. 5B. But the direction of rotation of the developing sleeve is opposite to that of the photoreceptor. In other words, the circumferential surface of the developing sleeve moves in the same direction as that of the photoreceptor at the position where the developing sleeve faces the photoreceptor. In this example, the developer amount regulating member 5 is installed at the position as shown in FIG. 14A. The developing sleeve 3 is made of nonmagnetic stainless steel. Its diameter is 30 ϕmm, and its surface roughness is '1 S'. The magnetic flux density of the magnetic roller is 700 gauss at the surface of the sleeve. The number of the poles is eight. The cylindrical bar is made of stainless steel, the diameter of which is 7 ϕmm. The cylindrical bar is installed close to a pole of the magnetic roller 4 and it is held between the nonmagnetic flat spring 6 to pres the bar and the developer amount regulating roller holder 156.

The main portion of this example of FIG. 14A is explained above, and other portions which are not shown in FIG. 14A are almost the same as those shown in FIG. 5B. In this embodiment, the pressure of the cylindrical bar onto the developing sleeve is the addition of the magnetic attraction, the weight of the bar, and the pressure by the flat spring 6. In the case that the developer amount regulating member 5 is made of a magnetic stainless steel, the regulating member 5 is magnetized by the magnetic field created by the stationary magnetic roller 4 in the developing sleeve, and attracted by the magnetic roller. The pressure is created by magnetic attraction by this method. The magnetic attraction by the cylindrical bar 5 is longitudinally uniform, and presses the developing sleeve 3 uniformly. As a result, an excellent developer layer can be obtained.

Figure 14B:
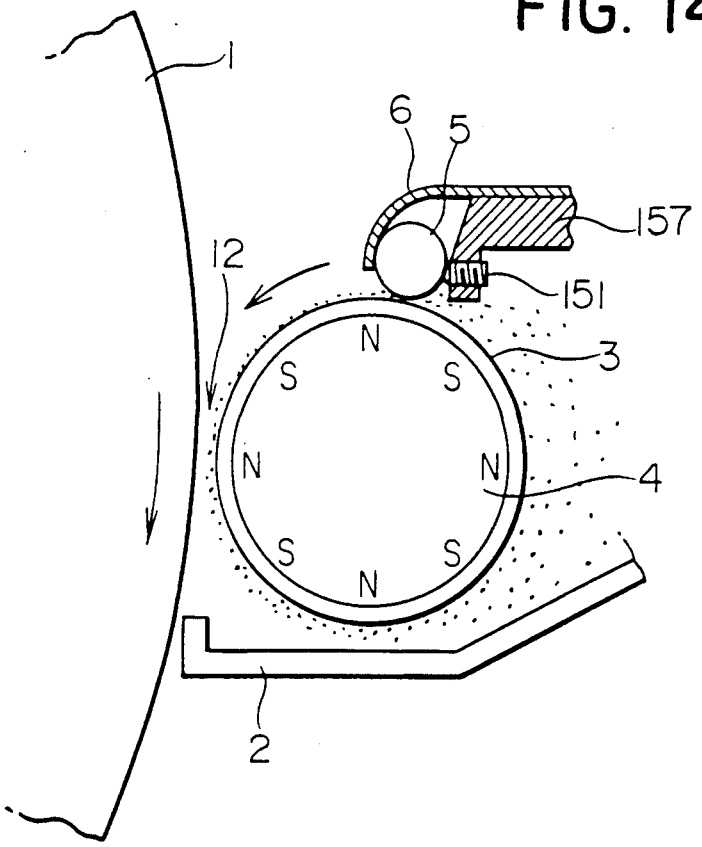

In this example, as shown in FIG. 14B, the position adjusting member 151 is possibly installed at the holder 157 and pushes the cylindrical bar 5 to the pressing flat spring 6 in order to adjust the position of the cylindrical bar 5.

In the above described embodiments, it is possible that the magnetic roller in the developing sleeve is provided as rotatable, and one-component developer can be used in stead of two-component developer.

The examples were explained above.

In the examples of the invention, a cylindrical bar was mainly used as the developer amount regulating member. But the invention is not restricted to that. The necessary conditions are that the pressing portion has rigidity and magnetism, and that the regulating member is bar-shaped with the radius ranging from 0.5 mm to 15 mm.

The following are the development conditions and the composition of the developer used in the present invention. It is preferable in the developing apparatus of the invention that the distance between the image carrier 1 and the developing sleeve 3, in other words, the value of 'd' in FIG. 6 should range from 0.3 mm to 0.7 mm, preferably from 0.4 mm to 0.6 mm. To reduce the distance between the photoreceptor 1 and the developing sleeve 3 makes the electric field effect bigger and arranges the direction of electric lines of force. Thus, image blurring can be eliminated during development. On condition that the distance is 0.5 mm, the height of the developer which looks like a brush, ranges from 200 μm to 450 μm by choosing a multipolar magnetic roller mentioned before. Accordingly, the gap between the top of the brush and the latent image, which is represented by (S-d), is kept to be a value ranging from 0.02 mm to 0.3 mm, namely it can be kept to be the value ranging from $0.1 \times d$ to $0.6 \times d$.

Even though it is possible for this invention to use either one-component type or two component type developer, the two-component type developer is more suitable as the developer used for the invention. The reason is that the two-component type developer has a self-cleaning function to clean up the toner which sticks to the developer amount regulating member. In view of the fact mentioned above, the two-component developer can form a stable developer layer for longer time than a monocomponent type developer.

One of the examples of a two-component type developer is explained as follows. The developer which consists of a nonmagnetic toner, the particle size of which ranges from 6 μm to 18 μm, and a ferrite carrier coated with resin, the particle size of which ranges from 10 μm to 100 μm, preferably from 30 μm to 60 μm, is desirable to the developing apparatus of the invention.

The details of the toner are as follows.

(1) Thermoplastic resin or binding agent from 80% by wt to 90% by wt

Examples : Polystyrene, Styrene acrylic polymer, Polyester, Polyvinyl butyral, Epoxy resin, Polyamide resin, Polyethylene, Ethylene vinyl acetate copolymer, etc., or mixtures of them (2) Pigment or colorant from 0% by wt to 15% by wt Examples :

Black : Carbon black

Yellow : Benzidine derivative

Magenta : Rhodamine B lake, Carmine 6B, etc.,

Cyan : Copper phthalocyanine, Sulfonamide derivative dye, etc., (3) Charge cotroller from 0% by wt to 5% by wt Plus charged toner:

Nigrosine type electrondonor type dye, Alkoxylated amine, Alkylamid, Chelate-compound, Pigment, A quaternary ammonium salt, etc., Minus charged toner:

Electroreceptive complex, Chlorinated paraffine, chlorinated polyester, Excessive acid group-containing polyester, Chlorinated copper phthalocyanine, etc., (4) Fluidizer Examples : Colloidal silica, Hydrophobic silica, Silicone varnish, Metallic soap, Nonionic surface active agent, etc., (5) Cleaning agent to remove toner film on the photoreceptor.

Examples : Fatty acid metal salt, Silicon oxide acid with organic group on its surface, Fluorione surface active agent, etc., (6) Filler to improve the gloss of the surface and to cut costs Examples : Calcium carbonate, Clay, Talc, Pigment, etc., A small amount of magnetic powder can be contained in it to prevent foggy images and spewing of toner. The details of magnetic powder to be used in this invention will be explained below. The grain size of the magnetic powder ranges from 0.1 μm to 1 μm. The materials are triron tetraoxide, γ-ferric oxide, chromium dioxide, nickel ferrite, iron alloy, and so forth. The ratio of content ranges from 0.1% by wt to 5% by wt. To keep a more distinct color, it is preferable that the ratio is less than 1% by wt.

The adhesive resins such as wax, polyolefin, ethylene vinyl acetate copolymer, polyurethane, and rubber are appropriate for pressure fixing wherein 20 kg/cm force is given for plastic deformation.

An experimental development was conducted under the conditions in which electric potential of the photoreceptor surface 1 is −600 V, that of the exposed part ranges from 0 to −100 V, and −500 V for DC bias and 700 V AC(rms) bias with 4 kHz frequency is given to the developing sleeve 3. The results were so good that high quality toner image with high resolution and excellent gradation were obtained.

The developing apparatus of the present invention is equipped with the developer layer thickness regulating member consisting of a rigid member of small radius of curvature which is pressed to the rigid developing sleeve with rigidness. Because of the structure of the developing apparatus of the invention explained above, the developer layer thickness on the developing sleeve is stable without being influenced by the variation of the developing sleeve rotating speed or pressing position. The apparatus of the invention can make a uniform and stable developer layer by a lighter torque compared with the conventional one.

The developing apparatus of the invention has excellent efficiency. The outstanding points are that the possibility of blocking caused by foreign objects is low, the efficiency of breaking the aggregated toner in pieces is high and white streaks hardly appear o the image. The variation of the pressure by the developer layer thickness regulating member has very little influence on the variation of the developer amount conveyed.

The developing unit of the invention is not deformed even if it is used for a long time, it has durability. When the apparatus of the invention is mass-produced, the assembly tolerance is quite large. That is one of the reason why this apparatus is practical.

The developing area is so small that there is no bad effect on the images by unnecessary electrification caused by friction.

In addition to that, the layer regulating member can be so easily exchanged that its maintenance efficiency is quite high.

In the example of the developing apparatus of the invention in which the developer amount regulator of a small radius with rigidity and magnetism is pressed to the developing sleeve with rigidity to form a developer layer forming unit, a developer layer of constant thickness can be obtained without being affected by the variation of the developing sleeve rotating speed or the pressing position, especially without being affected by the variation of the pressure of the developer amount regulator. Accordingly, a uniform and stable developer layer can be obtained by the developing apparatus of the invention with a light load compared with the conventional developing apparatus. The apparatus of the invention scarcely causes blocking by foreign objects is excellent in breaking aggregated toner into pieces, and white streaks hardly appear in this apparatus. In this developing apparatus, the variation of the developer amount is very little after the pressure at the pressing position on the developing sleeve by the developer amount regulating member has been once regulated. Therefore, the apparatus has excellent developing efficiency. Sticking of the two-component developer to the developer amount regulating member can be specially prevented in the apparatus. As a result, a uniformly thin developer layer is stably formed and high quality images without unevenness of density and deterioration of density can be obtained.

In the developing apparatus of this example, it is not deformed when it is used for a long time and the variation of magnetic attraction is little. Therefore, the developer amount regulator has durability. When mass-produced, its assembly tolerance can be quite large, thus this apparatus is appropriate to practical use.

In this apparatus, the developer regulating area is so small that bad effects are hardly caused by unnecessary electrification by friction of toner.

The developer amount regulating member is easily exchanged, so its maintenance efficiency is high.

When a nonlinear elastic body is used as the cylindrical bar pressing member, it results in absorbing the variation of tolerance of the casing or the holder and the variation of dimensional error in the assembly process. Accordingly, the developing apparatus of the invention can always convey a stable amount of developer even if an adjusting unit is not installed.

In the example of the developing apparatus of the invention in which the rigid and magnetic developer amount regulator of a small radius is pressed to the rigid developing sleeve to form a developer layer forming unit, a developer layer of stable thickness can be obtained without being affected by the variation of the developing sleeve rotating speed or the pressing position, especially without being affected by the variation of the pressure of the developer amount regulator. Accordingly, a uniform and stable developer layer can be obtained by the developing apparatus of the invention with a light load compared with the conventional developing apparatus. The apparatus of the invention scarcely causes blinding by foreign objects, is excellent at breaking aggregated toner to pieces, and white stripes hardly appear with this apparatus. In this developing apparatus, the variation of the developer amount is very little after the variation of the pressure at the pressing position on the developing sleeve by the developer amount regulating member, is regulated. Therefore, the apparatus has excellent developing efficiency. Sticking of the two-component developer to the developer amount regulating member can be specially prevented in the apparatus. As a result, a uniform thin developer layer is stably formed and high quality images without unevenness of density and deterioration of density can be obtained.

In the developing apparatus of this example, it is not deformed when it is used for a long time and the variation of magnetic attraction is little. Therefore, the developer amount regulator has durability. When it is mass-produced, its assembly tolerance can be quite large. Good operating condition can be set by a comparatively simple position adjusting unit in this apparatus. So, this apparatus is adequate to practical use.

In this apparatus, the developer regulating area is so small that bad effects are hardly caused by unnecessary electrification by friction of toner.

The developer amount regulating member is easily exchanged, so its maintenance efficiency is high.

When a nonlinear elastic body is used for the cylindrical bar pressing member, it results in absorbing the variation of tolerance of the casing or the holder and the variation of dimensional error in the assembly process. Accordingly, the developing apparatus of the invention can always convey stable amount of developer even if an adjusting unit is not installed to adjust the developer amount regulating member.

What is claimed is:

1. A developing apparatus for supplying a developer to an image holding means so that an electrostatic latent image on said image holding means is developed with said developer, said apparatus comprising;

developer conveyance means having a rigid surface, for conveying said developer to a developing zone;

a developer layer-thickness regulating means, shaped like a bar and having a rigid surface portion with a curvature radius between 0.5 mm and 15 mm, for regulating the thickness of said developer on said developer conveyance means; and a supporting means for supporting said developer layer-thickness regulating means, and for pressing said surface portion onto said developer conveyance means, said rigid surface of said developer conveyance means and said rigid surface portion of said developer layer-thickness regulating means having a rigidity of not less than $10^4$ kg/cm$^2$.

2. The apparatus claimed in claim 1, wherein said developer layer-thickness regulating means has a surface which is covered with a rubber material for the thickness between 0.01 mm and 5 mm, so that said developer layer-thickness regulating means is pressed onto said developer conveyance means through said rubber material.

3. The apparatus claimed in claim 1 wherein said supporting means supports said developer layer-thickness regulating means at two areas.

4. The apparatus claimed in claim 1 wherein said supporting means supports said developer layer-thickness regulating means with a nonlinear elastic member.

5. The apparatus claimed in claim 1 wherein said supporting means has an adjusting means whereby the position of said developer layer-thickness regulating means in relation to said supporting means is adjusted.

6. The apparatus claimed in claim 1 wherein said supporting means has a surface with flatness of not more than 0.2 mm to support said developer layer-thickness regulating means at a surface with cylindricity of not more than 0.1 mm.

7. The apparatus claimed in claim 1 wherein said developer layer-thickness regulating means is a cylindrical bar.

8. The apparatus of claim 1 wherein resilient contact is maintained between said regulating means and said conveyance means.

9. The apparatus of claim 2 wherein the rubber coating on said regulating means is 0.01 to 1.0 mm thick.

10. The apparatus of claim 6 wherein said cylindricity of said regulating means is not more than 0.05 mm.

11. A developing apparatus for supplying a developer to an image holding means so that an electrostatic latent image on said image holding means is developed with said developer, said apparatus comprising;

a developer conveyance means having a rigid surface and a magnet disposed therein, for conveying said developer to a developing zone;

a developer layer thickness regulating means, shaped like a bar, and having a rigid surface portion with a curvature radius of 0.5 to 15 mm, for regulating the thickness of said developer to be conveyed to said developing zone;

said rigid surface portion being formed of a magnetic material disposed facing said developer conveyance means; and a supporting means for supporting said developer layer thickness regulating means, and for pressing said surface portion onto said developer conveyance means said rigid surface of said developer conveyance means and said rigid surface portion of said developer layer thickness regulating means having a rigidity of not less than $10^4$ kg/cm$^2$.

12. The apparatus of claim 11 wherein said curvature radius is 1 to 10 mm.

13. The apparatus claimed in claim 11 wherein said disposed magnet is fixed so that said rigid surface portion of said developer layer-thickness regulating means is faced against said disposed magnet.

14. The apparatus claimed in claim 11 wherein said developer layer-thickness regulating means is pressed onto said developer conveyance means by magnetic force.

15. The apparatus claimed in claim 11 wherein said supporting means supports said developer layer-thickness regulating means at two areas.

16. The apparatus claimed in claim 11 wherein said supporting means supports said developer layer-thickness regulating means with a non-linear elastic member.

17. The apparatus claimed in claim 11 wherein said supporting means has an adjusting means whereby the position of said developer layer-thickness regulating means in relation to said supporting means is adjusted.

18. The apparatus claimed in claim 11 wherein said supporting means has a surface with flatness of not more than 0.2 mm to support said developer layer-thickness regulating means at a surface with cylindricity of not more than 0.1 mm.

19. The apparatus claimed in claim 11 wherein said developer layer-thickness regulating means is a cylindrical bar.

20. The apparatus of claim 18 wherein said cylindricity of said regulating means is not more than 0.05 mm.

21. A developing apparatus for supplying a developer to an image holding means so that an electrostatic latent image on said image holding means is developed with said developer, said apparatus comprising;

a developer conveyance means having a rigid surface and a magnet disposed therein, for conveying said developer to a developing zone;

a developer layer thickness regulating means, shaped like a bar and having a rigid surface portion with a curvature radius of 0.5 to 15 mm, for regulating the thickness of said developer to be conveyed to said developing zone;

said rigid surface portion being formed of a magnetic material, disposed facing said developer conveyance means;

wherein said developer layer thickness regulating means is disposed on the upper side of said developer conveyance means so that said developer layer thickness regulating means is pressed onto said rigid surface of said developer conveyance means by the magnetism of said rigid surface and the weight of said developer layer thickness means, wherein said rigid surface of said developer conveyance means and said rigid surface portion of said developer layer thickness regulating means have a rigidity of not less than $10^4$ kg/cm$^2$.

22. The apparatus of claim 21 wherein said curvature radius is 1 to 10 mm.

23. A developing apparatus for supplying a developer to an image holding means so that an electrostatic latent image on said image holding means is developed with said developer, said apparatus comprising;

a developer conveyance means having a rigid surface for conveying said developer to a developer zone;

a developer layer thickness regulating means, shaped like a bar and having a rigid surface portion covered with rubber;

said rigid surface having a curvature radius of 0.5 to 15 mm, for regulating the thickness of said developer to be conveyed to said developing zone; and a supporting means for supporting said developer layer thickness regulating means, and for pressing said surface portion onto said developer conveyance means wherein said rigid surface of said developer conveyance means and said rigid surface portion of said developer layer thickness regulating means have a rigidity of not less than $10^4$ kg/cm$^2$.

24. The apparatus of claim 23 wherein resilient contact is maintained between said regulating means and said conveyance means.

25. The apparatus of claim 23 wherein said curvature radius is 1 to 10 mm.

26. The apparatus of claim 23 wherein the rubber coating on said regulating means is 0.01 to 1.0 mm thick.

27. A developing apparatus for supplying a developer to an image holding means so that an electrostatic latent image on said image holding means is developed with said developer, said apparatus comprising;

a developer conveyance means having a rigid surface and a magnet disposed therein, for conveying said developer to a developing zone;

a developer layer thickness regulating means, shaped like a bar and having a rigid surface portion covered with a curvature radius of between 0.5 and 15 mm, for regulating the thickness of said developer to be conveyed to said developing zone; and said rigid surface portion being formed of a magnetic material, disposed facing said developer conveyance means;

wherein said developer thickness regulating means is pressed onto said rigid surface of said developer conveyance means by magnetic attraction between said rigid surface of said developer conveyance means and said rigid surface portion of said developer layer thickness regulating means have a rigidity of not less than $10^4$ kg/cm$^2$.

28. The apparatus of claim 27 wherein said curvature radius is 1 to 10 mm.

29. A developing apparatus for supplying a developer to an image holding means so that an electrostatic latent image on said image holding means is developed with said developer, said apparatus comprising a developer conveyance means having a rigid surface for conveying said developer to said developing zone; and a developer layer thickness regulating means, shaped like a bar and having a rigid surface portion with a curvature radius of 0.5 to 15 mm, for regulating the thickness of said developer to be conveyed to said developing zone;

wherein said developer layer thickness regulating means is supported so that the axis of said developer layer thickness regulating means is capable of moving in a direction of a line normal to the rigid surface of said developer conveyance means wherein said rigid surface of said developer conveyance means and said rigid surface portion of said developer layer thickness regulating means have a rigidity of not less than $10^4$ kg/cm$^2$.

30. The apparatus of claim 29 wherein resilient contact is maintained between said regulating means and said conveyance means.

31. The apparatus of claim 29 wherein said curvature radius is 1 to 10 mm.

* * * * *